US008371046B2

(12) United States Patent
Yanke et al.

(10) Patent No.: US 8,371,046 B2
(45) Date of Patent: Feb. 12, 2013

(54) STIRRUP

(75) Inventors: Paul H. Yanke, Milwaukee, WI (US); Charles H. Yanke, Milwaukee, WI (US)

(73) Assignee: OnTyte LLC, Mt. Vernon, AZ (US)

( * ) Notice: Subject to any disclaimer, the term of this patent is extended or adjusted under 35 U.S.C. 154(b) by 504 days.

(21) Appl. No.: 12/403,638

(22) Filed: Mar. 13, 2009

(65) Prior Publication Data

US 2009/0229146 A1 Sep. 17, 2009

Related U.S. Application Data

(60) Provisional application No. 61/036,819, filed on Mar. 14, 2008, provisional application No. 61/052,773, filed on May 13, 2008.

(51) Int. Cl.
*A43B 5/00* (2006.01)

(52) U.S. Cl. ..... 36/131; 36/114

(58) Field of Classification Search ..... 36/131, 36/114, 115

See application file for complete search history.

(56) References Cited

U.S. PATENT DOCUMENTS

| | | | | |
|---|---|---|---|---|
| 588,038 | A * | 8/1897 | Tudor | 74/594.6 |
| 3,927,897 | A * | 12/1975 | Olson et al. | 280/612 |
| 4,936,081 | A | 6/1990 | Jones | |
| 5,233,768 | A * | 8/1993 | Humphreys | 36/44 |
| 5,473,963 | A * | 12/1995 | Aeschbach | 74/594.6 |
| 5,704,256 | A * | 1/1998 | De Lattre | 74/594.6 |
| 5,853,854 | A * | 12/1998 | Nakanishi et al. | 428/172 |
| 6,863,583 | B2 * | 3/2005 | Takahashi | 441/74 |
| 6,865,867 | B1 | 3/2005 | Zucchini | |
| 7,654,015 | B2 * | 2/2010 | Nakayama | 36/130 |
| 7,721,470 | B2 * | 5/2010 | Long | 36/136 |
| 7,823,300 | B2 * | 11/2010 | Fullerton et al. | 36/113 |
| 2003/0075890 | A1 * | 4/2003 | Jacobs | 280/87.042 |
| 2003/0211789 | A1 * | 11/2003 | Taylor | 441/74 |
| 2003/0224676 | A1 | 12/2003 | Takahashi | |

FOREIGN PATENT DOCUMENTS

| | | |
|---|---|---|
| DE | 62244 | 6/1891 |
| DE | 3239993 | 5/1984 |
| DE | 3341268 | 5/1985 |
| DE | 102004050664 | 3/2006 |
| FR | 2726744 | 5/1996 |
| FR | 2753962 | 4/1998 |
| FR | 2850098 | 7/2004 |
| GB | 2399275 A | 9/2004 |

OTHER PUBLICATIONS

09250736 European Search Report, 5 pages, dated Jul. 2, 2009.

* cited by examiner

*Primary Examiner* — Marie Patterson
(74) *Attorney, Agent, or Firm* — Michael Best & Friedrich LLP

(57) ABSTRACT

A riding boot for use with a stirrup, the riding boot including a sole for engaging the stirrup, the sole coupled to the riding boot and a magnetic member coupled to the sole. The magnetic member is a polymer including a magnetic metal.

8 Claims, 23 Drawing Sheets

STIRRUP

CROSS-REFERENCE TO RELATED APPLICATIONS

This application claims priority to U.S. Provisional Patent Application No. 61/036,819, entitled "STIRRUP", filed Mar. 14, 2008 by Scott H. Yanke, Patricia A. Van Housen and Paul H. Yanke, and to U.S. Provisional Patent Application No. 61/052,773, entitled "STIRRUP", filed May 13, 2008 by Scott H. Yanke, Patricia A. Van Housen and Paul H. Yanke, the entire contents of which are hereby incorporated by reference.

BACKGROUND

The present invention relates to a stirrup for an equine riding saddle that retains a riding boot in position within the stirrup, and more particularly, to a stirrup that magnetically attracts a riding boot.

Typically, stirrups attach to a saddle by straps. In equestrian events and activities, a rider's feet are placed into the stirrups, thereby allowing the rider to maintain their balance on an equine (e.g., a horse). It is common for a rider's foot to fall out of the stirrup, often called "losing their stirrup" or "blowing their stirrup." If order to prevent this action, a rider's foot is held in the stirrup by a variety of make-shift restraints, such as rubber bands, strings, leather, or fabric ties. Such restraints usually require assistance to put on, are unsightly in competitive arenas, and are outlawed by the governing bodies of various equestrian sports.

Another tool for holding a foot in a stirrup utilizes a binding, similar to a ski or bicycle binding. Bindings are dangerous because when a rider falls, the bindings do not automatically release. Therefore, an assistant is required to lock and unlock the bindings with respect to the rider's feet. Bindings are also outlawed in various equestrian sports.

SUMMARY

In one embodiment, the invention provides a riding boot for use with a stirrup. The riding boot includes a sole for engaging the stirrup, the sole coupled to the riding boot and a magnetic member coupled to the sole. The magnetic member is a polymer including a magnetic metal.

In a further embodiment, the invention provides a strap system for use with a riding boot and stirrup. The strap system includes a strap body defining an adjustable portion, wherein the strap body is adjustable to releasably couple the strap system to the riding boot, and a magnetic member.

In another embodiment, the invention provides a stirrup. The stirrup includes a base for supporting a riding boot and a magnetic member supported by the base. The magnetic member is configured to magnetically attract the riding boot to the base so as to releasably secure the riding boot to the stirrup. The stirrup further includes a pad coupled to the base wherein the magnetic material is positioned between the pad and the base.

In still another embodiment, the invention provides a method of manufacturing a sole for a riding boot. The method includes forming a pocket in the sole, the sole configured for coupling to the riding boot and inserting a magnetic member in the pocket. The magnetic member is substantially surrounded by a polymeric material.

In another embodiment, the invention provides a sole kit for a riding boot. The sole kit includes a sole including a pocket and a magnetic member positioned in the pocket. At least one of the sole and the magnetic member are configured for coupling to the riding boot.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
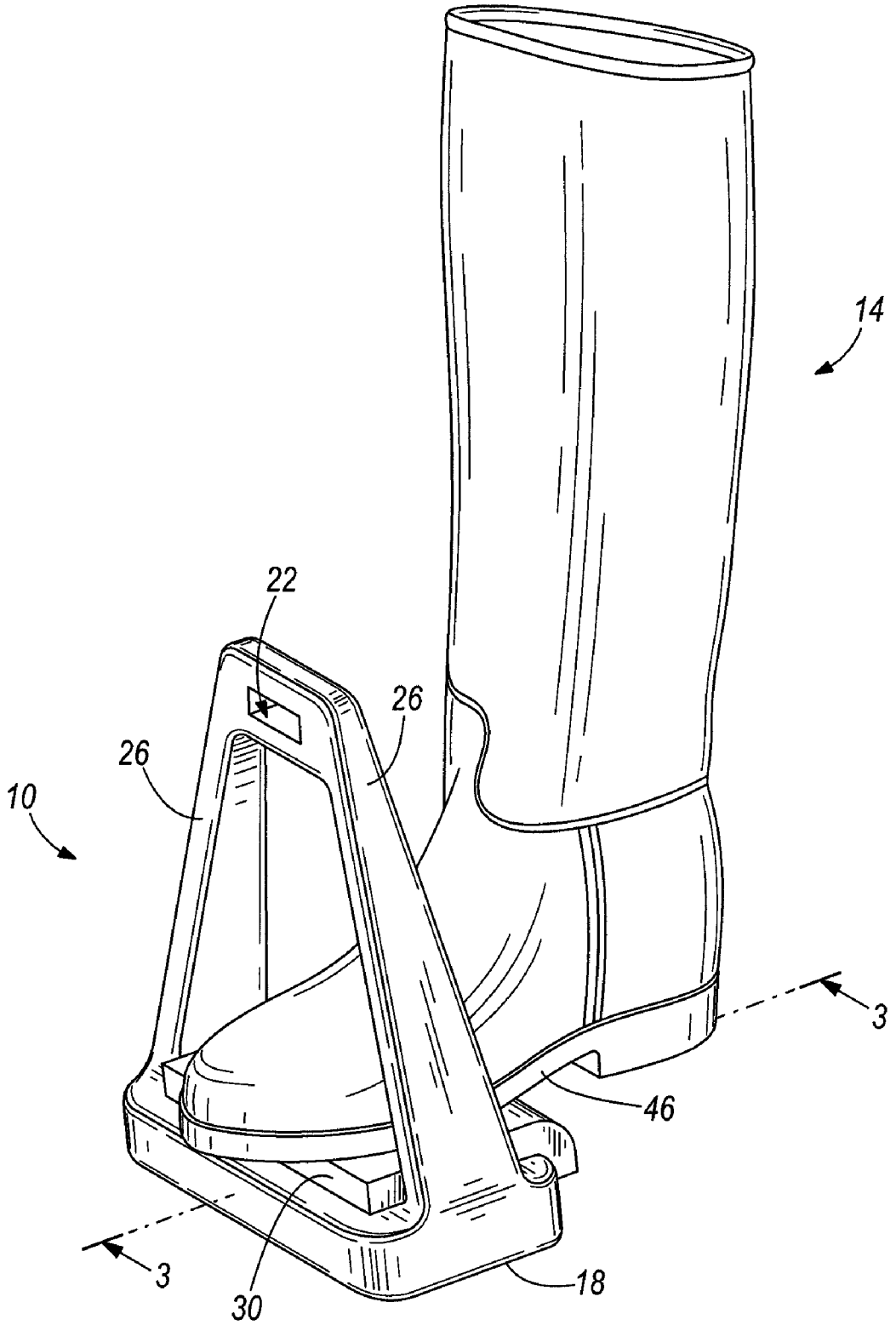
FIG. 1 is a perspective view of a magnetic stirrup and a riding boot according to an embodiment of the invention.
Figure 2:
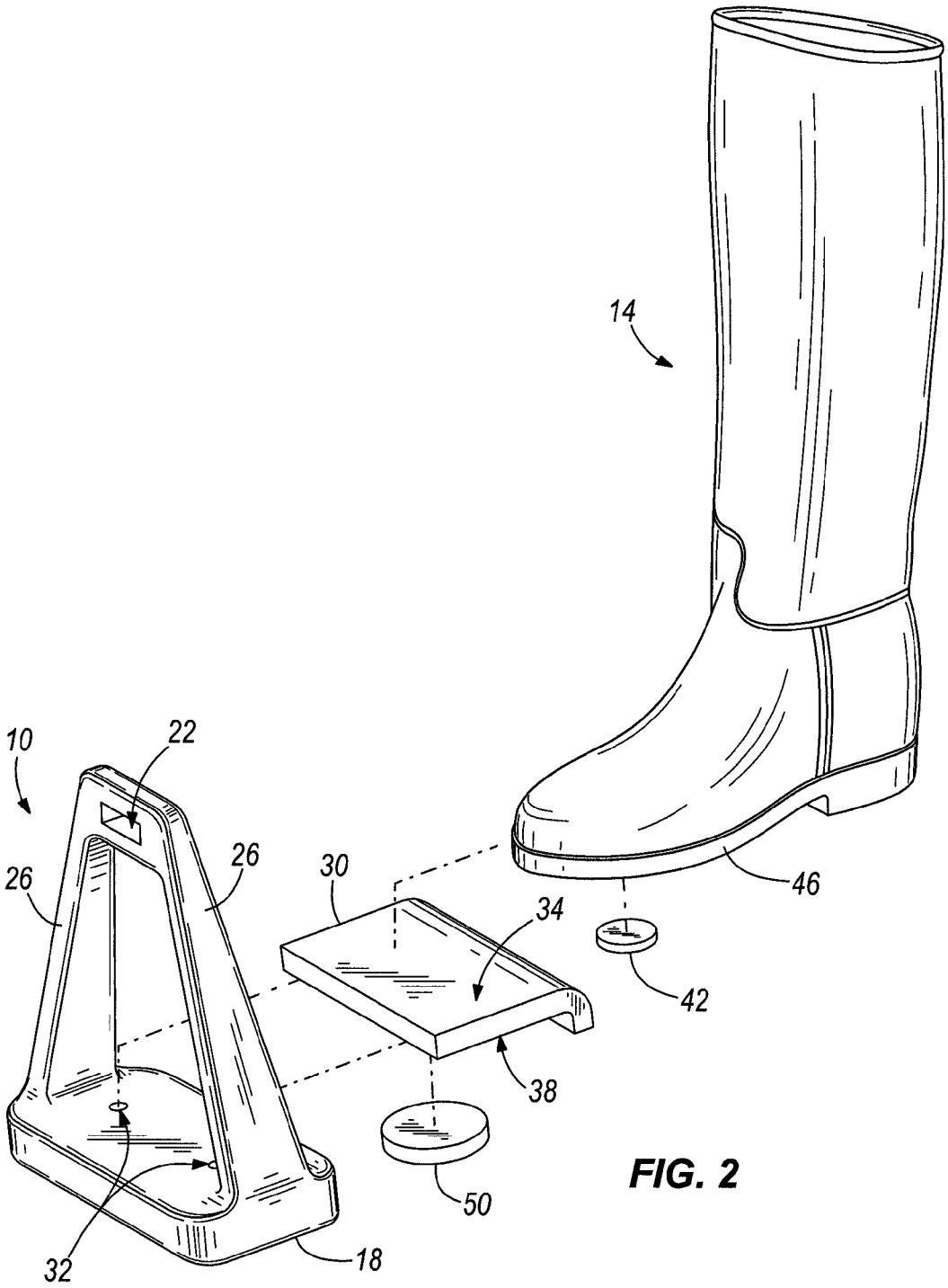
FIG. 2 is an exploded view of the magnetic stirrup and the riding boot shown in FIG. 1.
Figure 3:
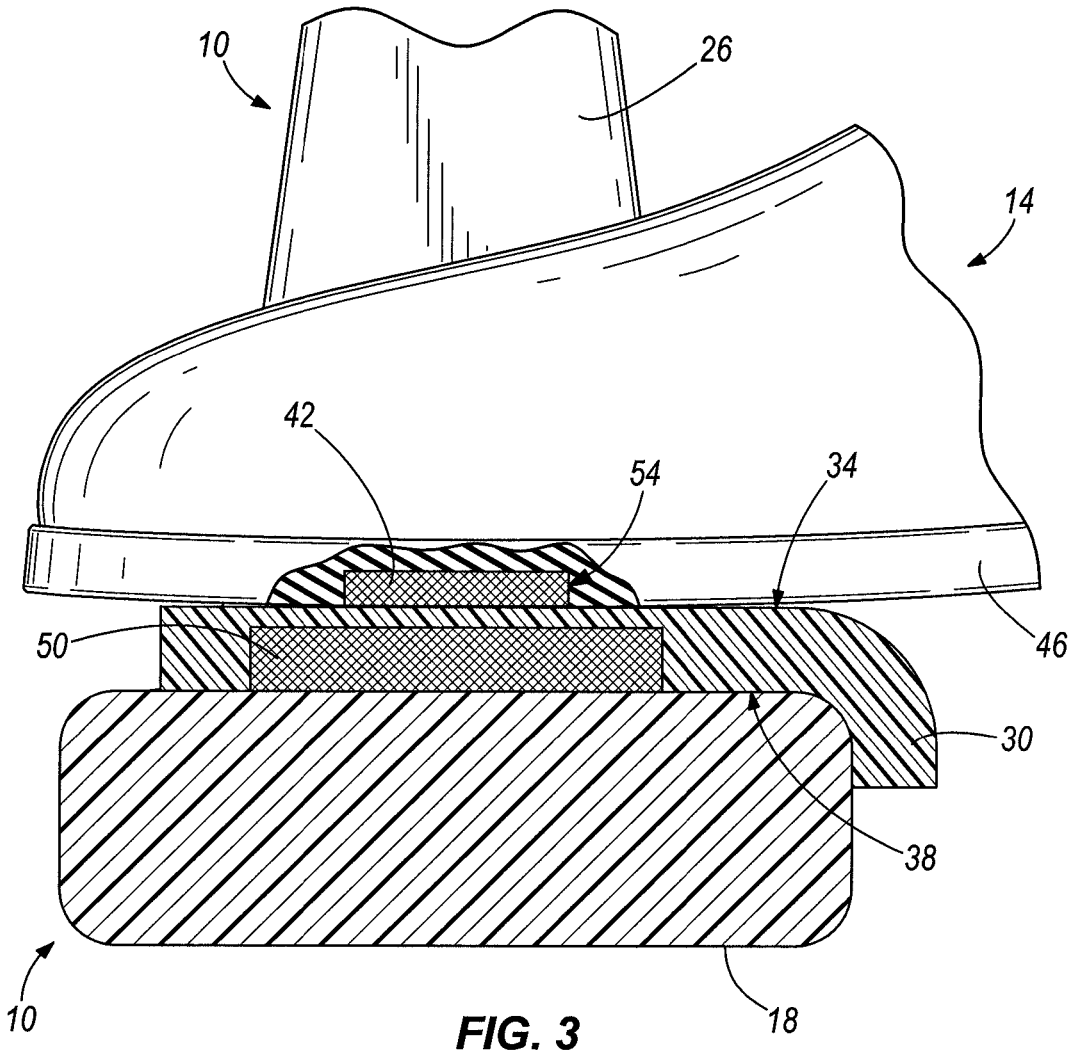
FIG. 3 is a cross-section view of the magnetic stirrup and the riding boot taken along line 3-3 in FIG. 1.

FIGS. 1-3 illustrate a magnetic stirrup 10 and a riding boot 14 according to one embodiment of the invention. The stirrup 10 and the riding boot 14 form a riding system for use with various riding animals. As shown in FIGS. 1 and 2, the stirrup 10 includes a base 18, an eye 22 for a strap to connect the stirrup to a saddle, such as a leather strap, and two branches 26 extending between the base 18 and the eye 22. The stirrup 10 may be formed of various materials, such as steel, stainless steel, iron, plated nickel, plastic, aluminum, wood, leather, and composites. Furthermore, the stirrup 10 may be formed of any metal as is known in the art. The magnetic stirrup 10 may be either English-style, as shown, or Western-style.

In the illustrated embodiment, a tread or foot pad 30 is removably coupled to the base 18 using fasteners (e.g., screws) inserted through apertures 32 in the base 18. The foot pad 30 includes a first surface 34 for interfacing with the riding boot 14, and a second surface 38 opposite the first surface 34. In a further embodiment, the foot pad 30 may be permanently attached to the base 18. The foot pad 30 may include ribs or another textured surface to provide friction between the foot pad 30 and riding boot 14. The foot pad 30 may be formed of various materials, such as metal (e.g., steel), plastic, rubber, urethane, silicon or leather. In some embodiments, the foot pad is molded using injection molding (i.e., high or low pressure injection molding), gravity molding, vacuum molding or any molding process.

Referring to FIGS. 2 and 3, a first attractant or first magnetic member 42, which exhibits magnetic behavior, is coupled to or imbedded in a sole 46 of the riding boot 14. A second attractant or second magnetic member 50, which also exhibits magnetic behavior, is coupled to or imbedded in the foot pad 30. In the illustrated embodiment, the second magnetic member 50 is recessed from the second surface 38. In other embodiments, the second magnetic member 50 may be coupled to or imbedded in the base 18 of the stirrup 10. The sole 46 is generally formed of rubber or other polymeric material.

In some embodiments, the style or discipline of equine riding determines the riding boot placement in the stirrup and therein the first magnetic member and the second magnetic member placement in the riding boot and foot pad, respectively.

In one embodiment, the foot pad 30 is molded using one of the above-identified processes and then the second magnetic member 50 is assembled into the foot pad 30 either as a pre-formed structure or an injected material to be shaped as the second magnetic member 50. In another embodiment, the foot pad 30 is injected around the second magnetic member 50. In yet another embodiment, the foot pad 30 is made of multiple pieces and the second magnetic member 50 is inserted into at least one of the pieces prior to assembling the foot pad 30. In other embodiments, the foot pad 30 is formed such that the second magnetic member 50 is inserted into the foot pad 30 without deforming the foot pad 30 or using adhesive to hold the second magnetic member 50 in the foot pad 30. In still other embodiments, the foot pad 30 is adhered, mechanically or welded onto the stirrup 10 using a two piece foot pad 30.

The boot sole 46 includes a pocket 54 for inserting the first magnetic member 42. The pocket 54 may be molded (i.e., premolded) within the sole 46, or machined into the sole 46. The first magnetic member 42 may be removable from the pocket 54. In some embodiments, the first magnetic member 42 is inserted into the sole 46 during the molding of the sole 46 and therein defines the pocket 54.

In the illustrated embodiment, the first magnetic member 42 is positioned within a recess of the sole 46 so as to be flush with the first surface 34 of the foot pad 30. The position within the sole 46 prevents the first magnetic member 42 from generating sound against the ground or stirrup 10, as well as limiting slipperiness between the riding boot 14 and the ground. In some embodiments, the distance of the first magnetic member 42 from the second magnetic member 50 impacts the effectiveness of the magnetic attraction. In other embodiments, the first magnetic member 42 is coupled to the sole 46 so as to be recessed into the sole 46 away from the first surface 34 of the foot pad 30.

In the illustrated embodiment, the first magnetic member 42 is recessed into the boot sole 46 and is exposed to the foot pad 30. In other embodiments, the first magnetic member 42 is imbedded in the sole 46 so as to be hidden or not exposed. The material forming the sole 46 has substantially minimal impact on the effectiveness of the first and second magnetic members 42, 50.

The first and second magnetic members 42, 50 may be formed of various conventional magnetic materials. For example, in some embodiments, the first and second magnetic members 42, 50 are formed of ferromagnetic materials, such as steel, carbon steel or iron, which produce magnetic fields that attract one another. In another embodiment, the magnetic members 42, 50 are composites loaded with metal. In other embodiments, either of the first or second magnetic members 42, 50 is formed of a ferromagnetic material whereas the other attractant is formed of a paramagnetic material, which does not produce a magnetic field, but is attracted to the magnetic field of the ferromagnetic material. In still other embodiments, the first magnetic member 42 and/or the second magnetic member 50 may be formed of a plastic or polymer that includes magnetic material imbedded or impregnated therein.

In some embodiments, the first magnetic member 42 is formed of a metal that does not produce a magnetic field; however, the first magnetic member 42 is attracted to a magnetic field. The second magnetic member 50 is a permanent magnet, such as a neodymium magnet. In other embodiments, the second magnetic member 50 may be formed of various materials such as samarium cobalt, alnico, ceramic or ferrite. The type, size and shape of the second magnetic member 50 utilized in the stirrup 10 determines the effectiveness or amount of magnetic attraction between the first and second magnetic members 42, 50. In some embodiments, the thickness and size of the first magnetic member 42 may be varied to correspond to the type, size and shape of the second magnetic member 50 in order to provide a desired amount of attraction between the first and second magnetic members 42, 50.

As illustrated, the first and second magnetic members 42, 50 are disk-like magnets of opposing poles and are therefore magnetically attracted to one another. The first magnetic member 42 is formed of a magnetic material that has a magnetic field. The magnetic field couples the stirrup 10 (i.e., the second magnetic member 50) to the sole 46 of the riding boot 14 and thereby prevents a rider's foot from slipping through, or falling out of, the stirrup 10. If a rider does fall off the equine (e.g., horse, mule, etc.), the attraction of the first and second magnetic members 42, 50 is broken by the force of the rider's fall; therefore, allowing the rider's foot to fall out of the stirrup 10 rather than remaining entangled with the stirrup 10. In further embodiments, the attractants 42, 50 may have other shapes (e.g., block or plate), or that the second magnetic member 50 is formed of a magnetic material with a magnetic field to attract the boot 14.

In some embodiments, either or both of the first and second magnetic members 42, 50 are electromagnets that include magnetic fields produced by flow of an electric current supplied by, for example, a small and/or portable battery.

In some embodiments, the first magnetic member 42 includes a plate imbedded in or coupled to the sole 46 of the riding boot 14. The plate may be a single piece or multiple pieces of varying thicknesses, whereby a multiple piece attractant allows the boot sole to bend. The plates may be stacked or positioned side to side. In some embodiments, the plate may be formed of powdered or rolled metal (e.g., steel or iron).

In some embodiments, a backer plate (not shown) formed of, for example, steel is used to increase the magnetic effectiveness between the first and second magnetic members 42, 50. The backer plate is coupled to or positioned adjacent to the first magnetic member 42 opposite of the second magnetic member 50. In other embodiments, the backer plate is coupled to or positioned adjacent the second magnetic member 50 opposite of the first magnetic member 42. In still other embodiments, backer plates are associated with each of the magnetic members 42, 50.

In other embodiments, the first and second magnetic members 42, 50 may be arranged in various positions to increase and decrease the magnetic effectiveness. In some embodiments, either or both of the magnetic members 42, 50 may be assembled to form a Halbach array.

In other embodiments, the first magnetic member 42 may be coupled to the riding boot 14 by sliding the first magnetic member 42 between the sole 46 and the bottom of the riding boot 14.

In other embodiments, the first magnetic member 42 is held to the exterior surface or the sole 46 of the riding boot 14 by an adhesive or a mechanical means.

Figure 3A:
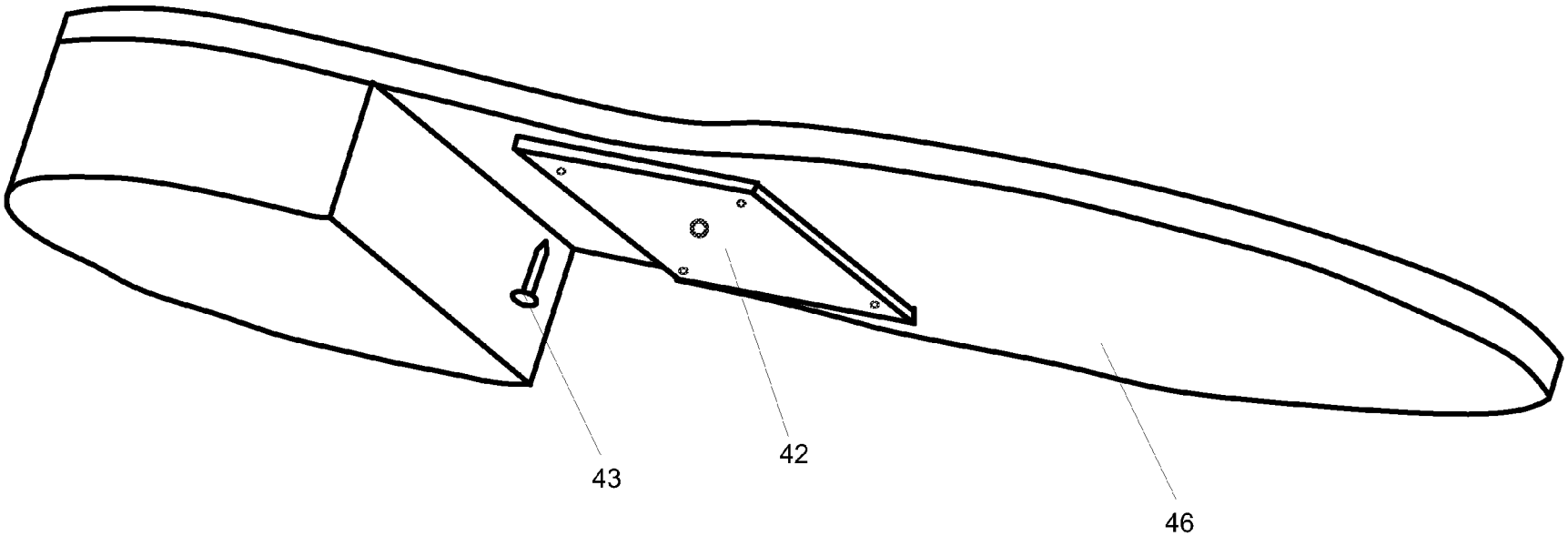
FIG. 3A is a perspective view of a sole of a riding boot according to another embodiment of the invention.

In other embodiments and as shown in FIG. 3A, the riding boot may be a conventional riding boot that is modified to include the first magnetic member 42. In the illustrated embodiment, the first magnetic member 42 is coupled to the sole 46 of a riding boot with nails 43. However, in other embodiments, the first magnetic member 42 is coupled to the sole 46 of a riding boot with tacks, screws, adhesive, Velcro, or other mechanical fasteners.

Figure 4:
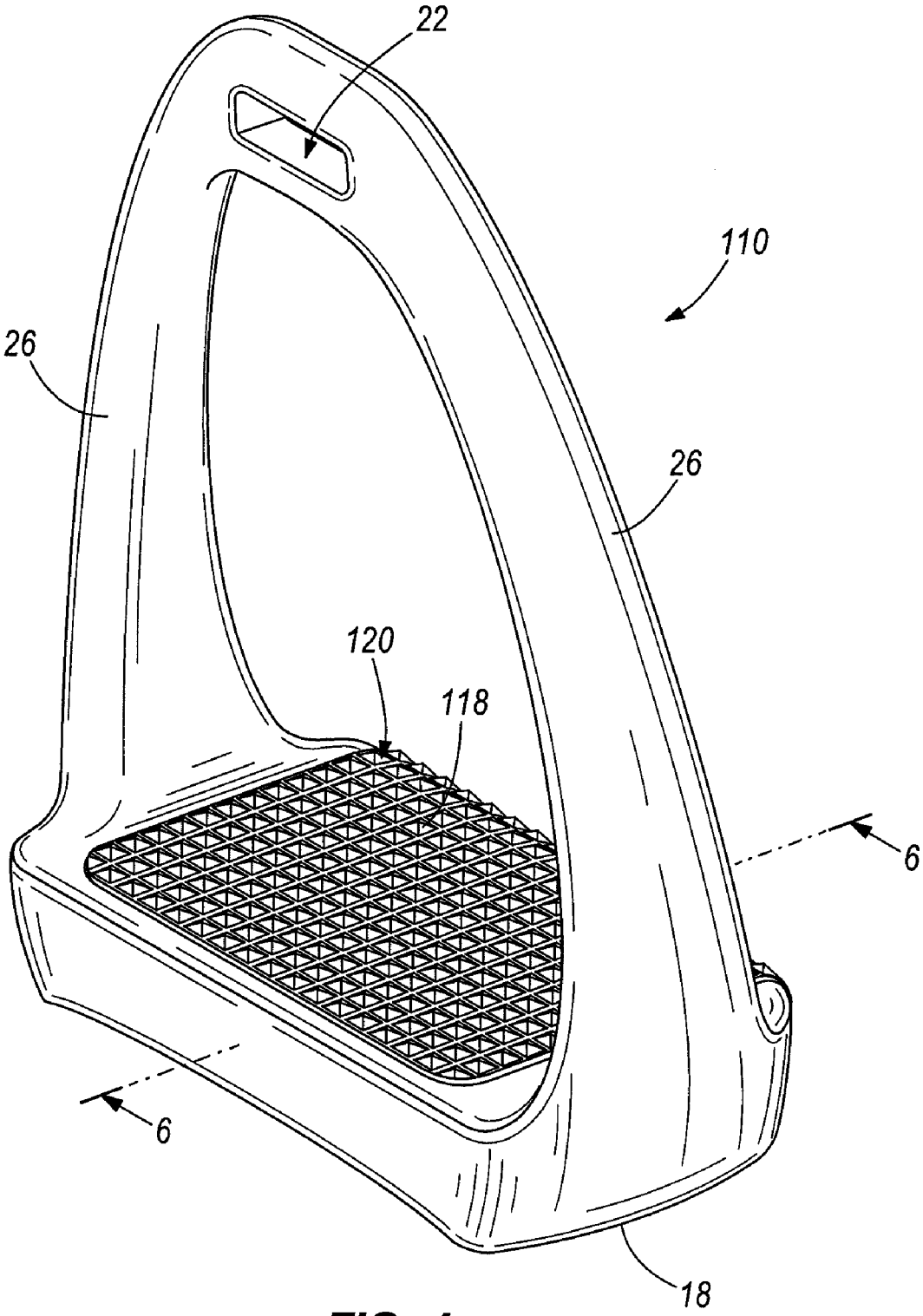
FIG. 4 is a perspective view of a magnetic stirrup according to another embodiment of the invention.
Figure 5:
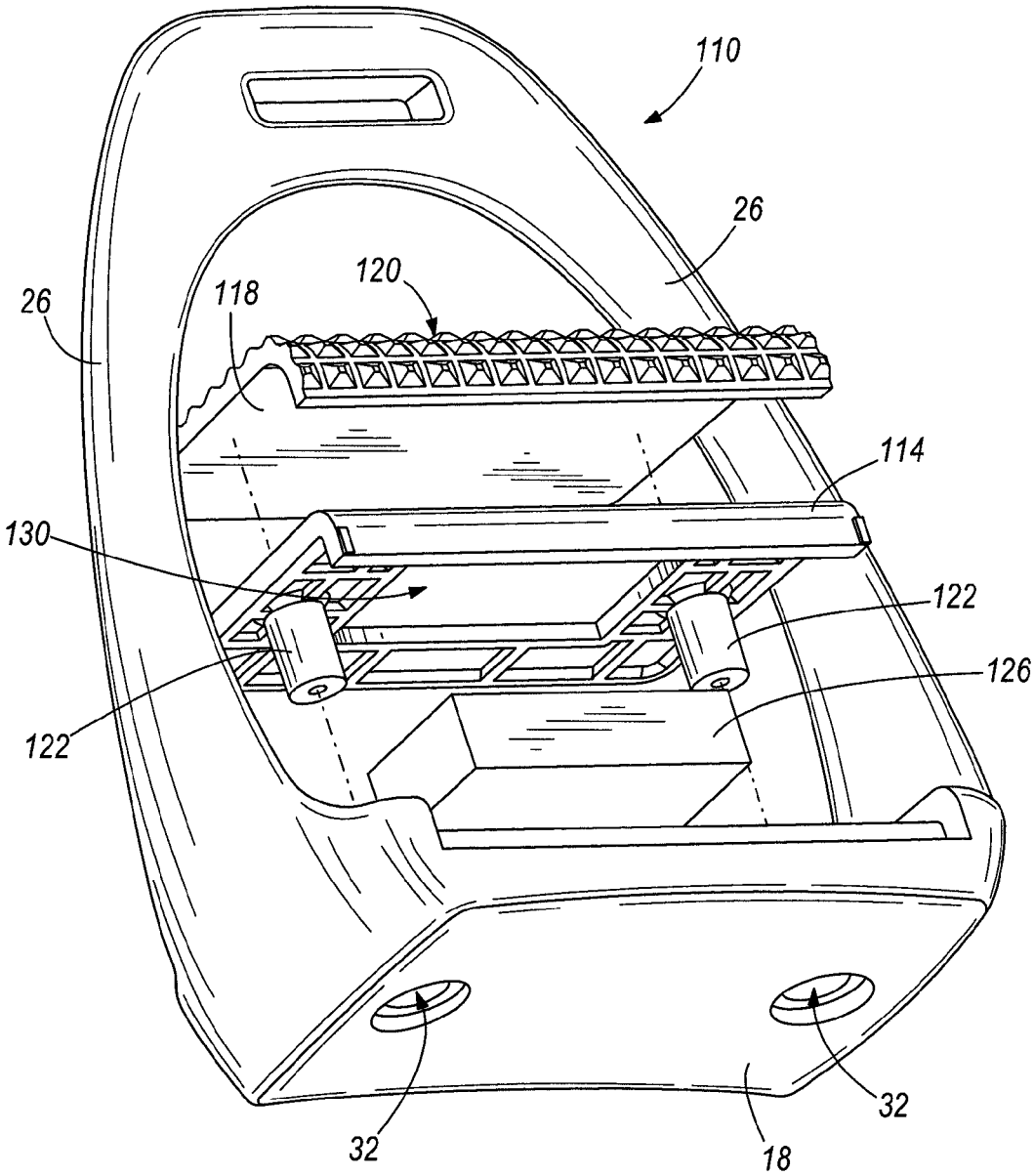
FIG. 5 is an exploded view of the magnetic stirrup shown in FIG. 4.
Figure 6:
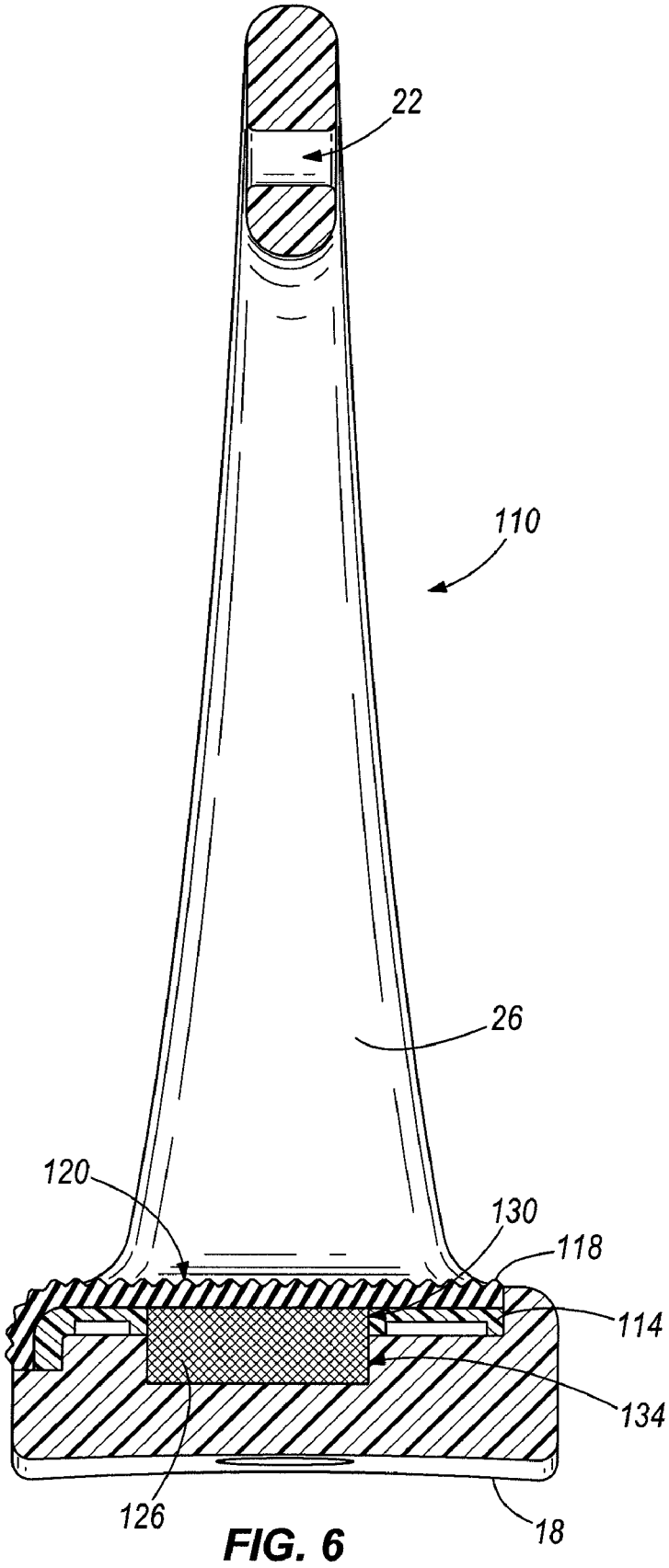
FIG. 6 is a cross-section view of the magnetic stirrup taken along line 6-6 in FIG. 4.

FIGS. 4-6 illustrate a magnetic stirrup 110 according to another embodiment of the invention. The magnetic stirrup 110 is similar to the magnetic stirrup 10 shown in FIGS. 1-3; therefore, like structure is identified by the same reference numerals. The magnetic stirrup 110 includes a base pad 114 and a foot pad 118 coupled to the base pad 114. The foot pad 118 provides a textured surface 120 for a user's riding boot (e.g., riding boot 14 shown in FIGS. 1-3) to engage. In the illustrated embodiment, the foot pad 118 is rubber molded over the base pad 114 such that the base and foot pads 114, 118 form a single pad, although for the purpose of illustration, the foot pad 118 is shown as a separate piece. In some embodiments, the base and foot pads 114, 118 are formed as individual parts and are coupled together post-manufacturing. The base pad 114 includes cylindrical projections 122, which are inserted through apertures 32 in the base 18. The projections 122 are releasably coupled to the base 18 of the stirrup 110 via fasteners (e.g., screws). A block-like magnetic member 126 is positioned between the base pad 114 and the base 18, and magnetically attracts a first magnetic member (e.g., the first magnetic member 42 described above and shown in FIGS. 1-3) in a riding boot. In further embodiments, the magnetic member 126 may be formed as other shapes such as a disk, a plate or granules. The magnetic member 126 is held in a recessed area 130 of the base pad 114 (FIG. 5) and a recessed area 134 of the base 18 (FIG. 6). Fasteners attach the pads 114, 118 to the base 18 and hold the magnetic member 126 in the recessed areas 130, 134.

In some embodiments, a thin steel plate is positioned between the magnetic member 126 and the base 18 to increase the effectiveness of the magnetic member 126, similar to the backer plate discussed above with respect to FIGS. 1-3.

In other embodiments, the base pad 114 is coupled to the base 18 by press-fitting the projections 122 through apertures 32 of the base 18. In some embodiments, the magnetic member 126 is positioned in the base 18 and is spaced apart from the base and foot pad 114, 118 such that no recessed area 130 is formed in the base pad 114. In still other embodiments, an existing stirrup including a foot pad is modified to include magnetic member 114. For example, the foot pad (and base pad) of the existing stirrup is removed from the stirrup to expose a bottom surface of the pad and then the recessed area 130 is formed in the pad. Furthermore, the recessed area 134 is formed in the existing base such that the magnetic member 130 can be positioned in the recessed areas 130, 134 between the modified pad and base.

In other embodiments, the material that forms the foot pad 30 may be a magnetic material, thereby forming the second magnetic member 50. The material that forms the foot pad 30, such as the steel, is a magnetic material that magnetically attracts the first magnetic member 42 and therein couples the stirrup 10 to the riding boot 14.

Figure 6A:
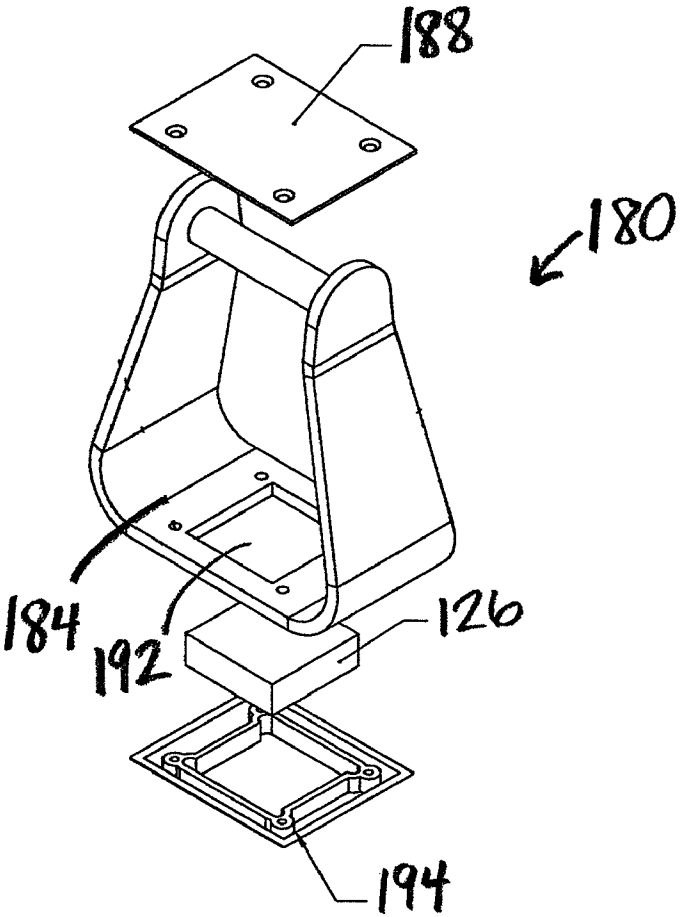
FIG. 6A is an exploded view of a magnetic stirrup according to another embodiment of the invention.
Figure 6C:
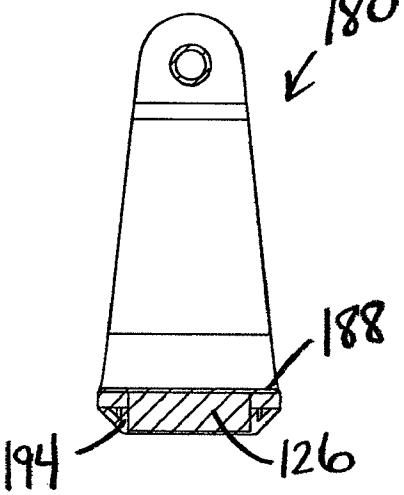
FIG. 6C is a cross-section view of the magnetic stirrup taken along line A-A in FIG. 6A.
Figure 6B:
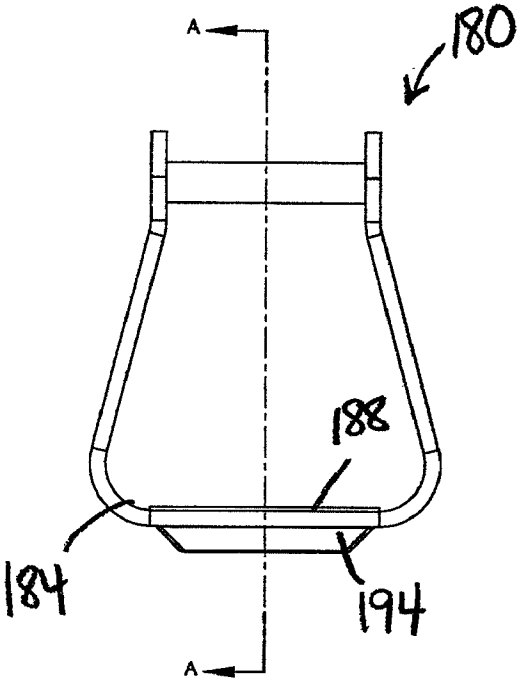
FIG. 6B is a front view of the magnetic stirrup shown in FIG. 6A.

FIGS. 6A-6C illustrate a magnetic stirrup 180 according to another embodiment of the invention. The magnetic stirrup 180 is similar to the magnetic stirrup 110 shown in FIGS. 1-3; therefore, like structure is identified by the same reference numerals. The magnetic stirrup 180 includes a base 184 and a foot pad 188 coupled to the base 184. The foot pad 188 provides a textured surface for a user's riding boot (e.g., riding boot 14 shown in FIGS. 1-3) to engage. The magnetic member 126 is positioned in the stirrup 180 through an opening 192 formed in the stirrup base 184. A magnetic holder 194 is configured to receive the magnetic member 126 and is coupled to the stirrup base 184 with fasteners or other coupling means. The foot pad 188 is positioned on an opposite side of the magnetic member 126 as the magnetic holder 194. The foot pad 188 is coupled to the stirrup base 184 with fasteners or other coupling means.

Figure 6D:
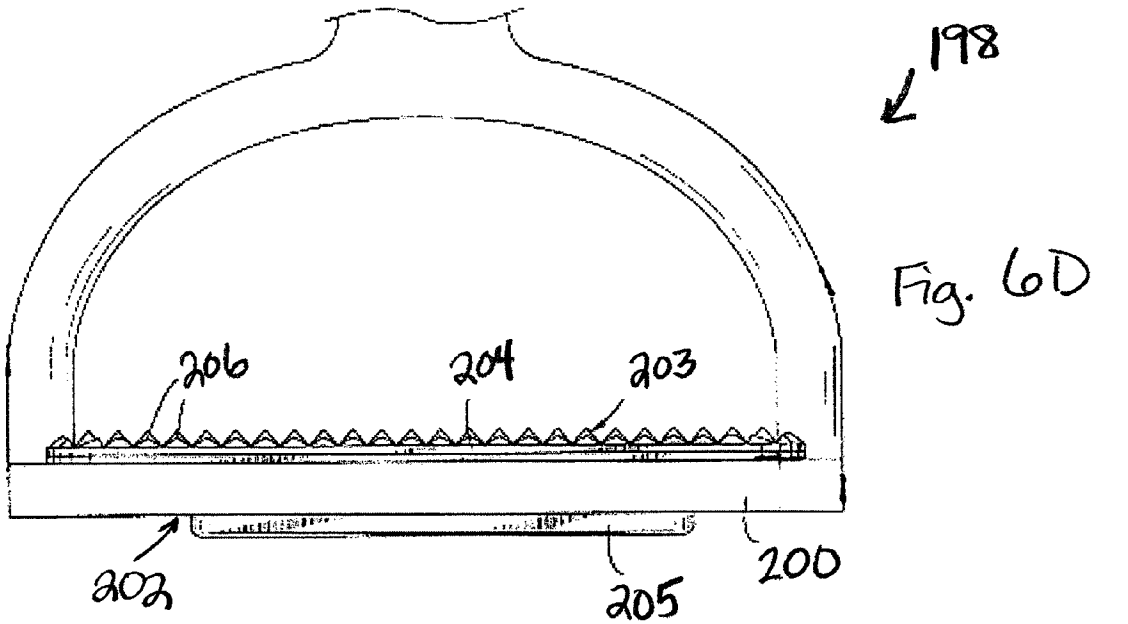
FIG. 6D is a side view of a magnetic stirrup according to another embodiment of the invention.
Figure 6E:
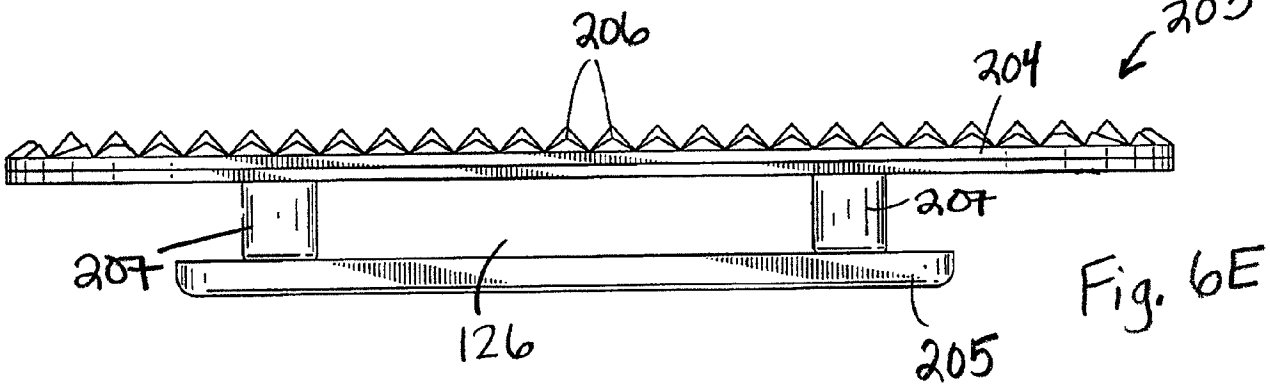
FIG. 6E is a side view of a magnetic holder of the magnetic stirrup of FIG. 6D.

FIGS. 6D-6E illustrate a magnetic stirrup 198 according to another embodiment of the invention. The magnetic stirrup 198 is similar to the magnetic stirrup 110 shown in FIGS. 1-3; therefore, like structure is identified by the same reference numerals. The magnetic stirrup 198 includes a base 200 and an opening 202 configured to receive a magnetic holder 203. The magnetic holder 203 includes a foot pad 204 coupled to a holder base 205 with fasteners 207 or other spacers. As illustrated, the fasteners 207 extend from the holder base 205 through opening 202 and into foot pad 204, such that tightening of the fasteners 207 retains the magnetic holder 203 in rigid assembly with the base 200. In some embodiments, the fasteners 207 extend from the holder base 205 through base 200 and into foot pad 204. The foot pad 204 provides a textured surface 206 for a user's riding boot (e.g., riding boot 14 shown in FIGS. 1-3) to engage. The foot pad 204 may be formed of aluminum, steel, rubber, plastic, or other suitable material. The magnetic member 126 is positioned in the magnetic holder 203 between the foot pad 204 and the holder base 205. In some embodiments, the magnetic member 126 is retained between the holder base 205 and the foot pad 204 by tightening of the fasteners 207. In some embodiments, the fasteners 207 extend through the magnetic member 126 to couple the magnetic member 126 to the magnetic holder 203. In other embodiments, the magnetic member 126 is coupled to the magnetic holder 203 or otherwise retained within the magnetic holder 203 with adhesive or other coupling means.

Figure 7:
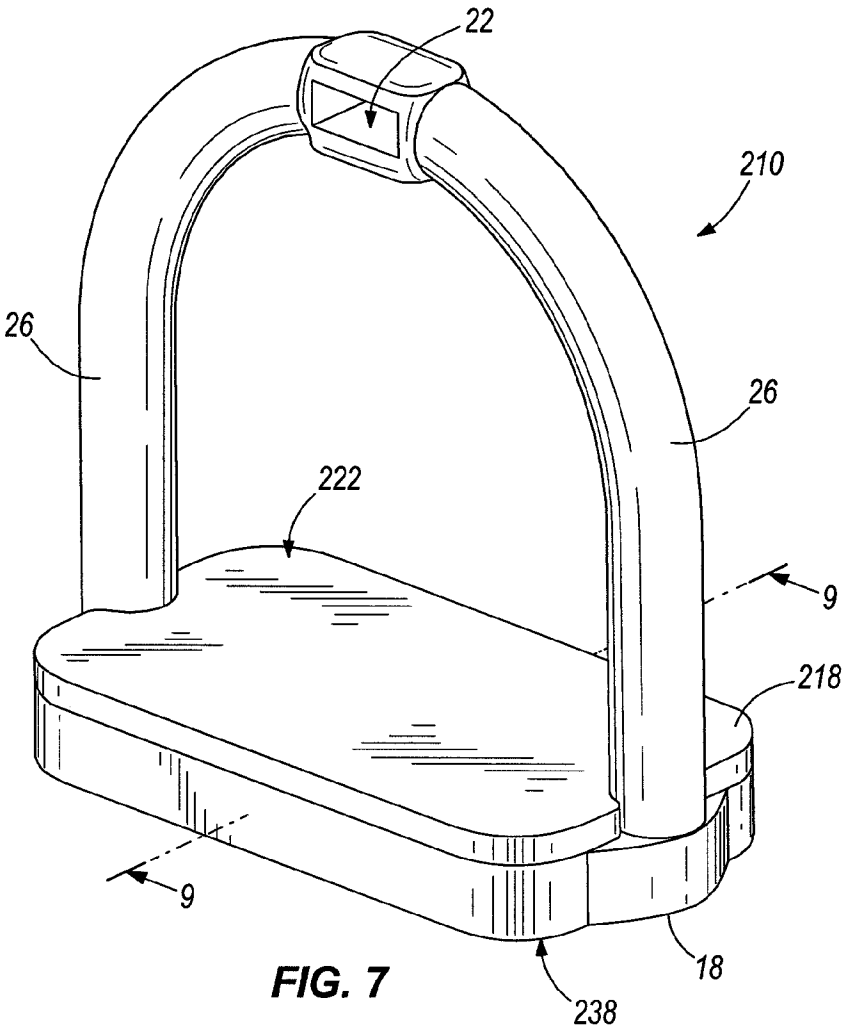
FIG. 7 is a perspective view of a magnetic stirrup according to another embodiment of the invention.
Figure 9:
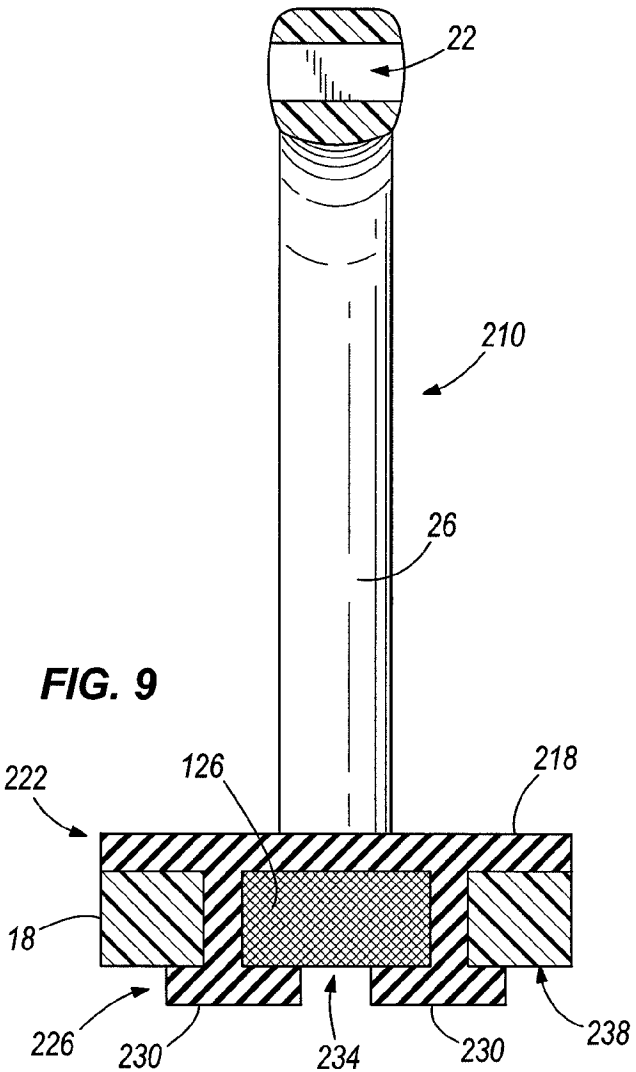
FIG. 9 is a cross-section view of the magnetic stirrup taken along line 9-9 in FIG. 7.
Figure 8:
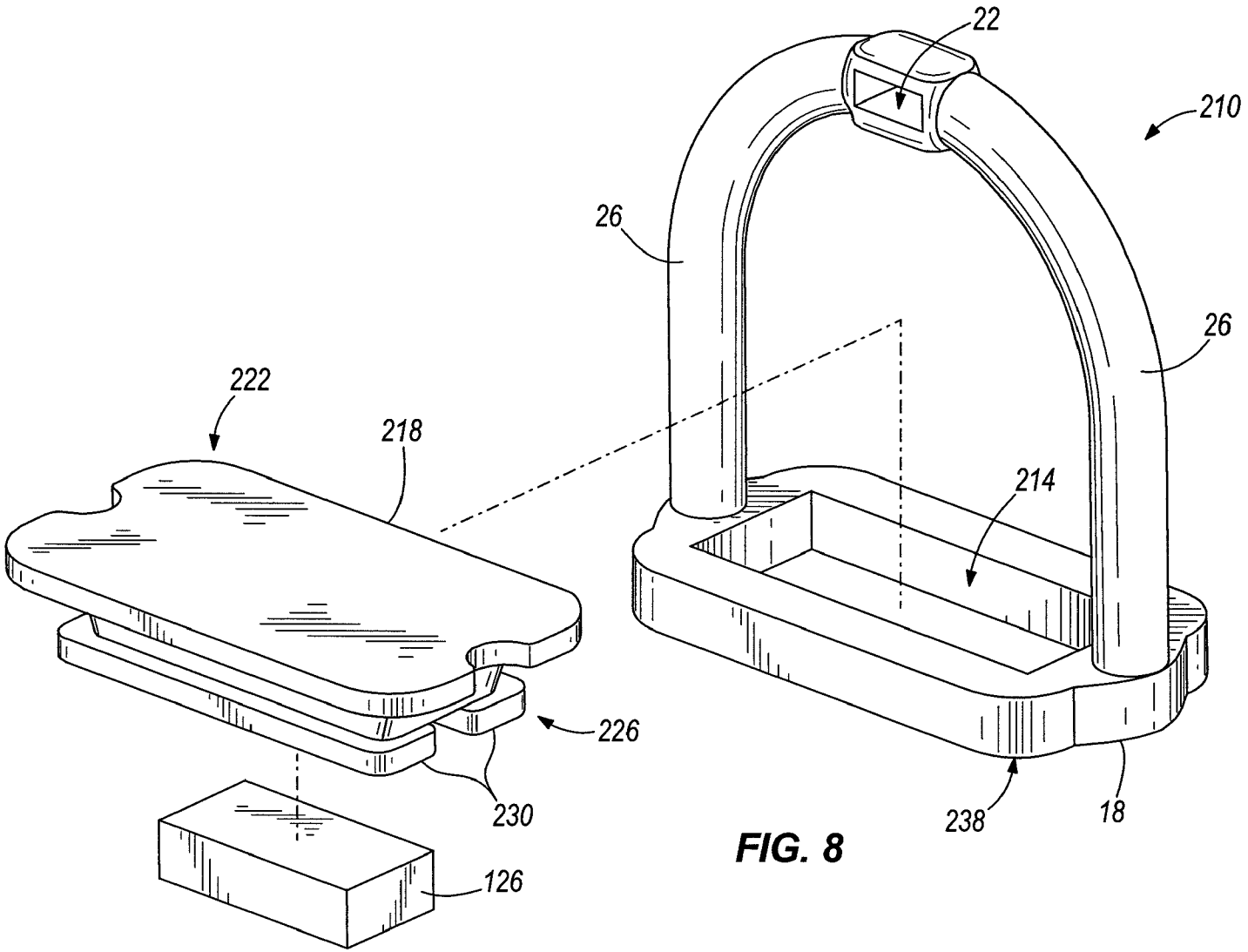
FIG. 8 is an exploded view of the magnetic stirrup shown in FIG. 7.

FIGS. 7-9 illustrate a magnetic stirrup 210 according to another embodiment of the invention. The magnetic stirrup 210 is similar to the magnetic stirrup 10 shown in FIGS. 1-3; therefore like structure is identified by the same reference numerals. The magnetic stirrup 210 includes an opening 214 and a foot pad 218 coupled to the base 18 of the stirrup 210 by press fitting the foot pad 218 through the opening 214. The foot pad 218 includes an upper portion 222, which engages a riding boot, and a lower portion 226, which is inserted through the opening 214. In one embodiment, the upper portion 222 includes ribs to frictionally engage the riding boot. The lower portion 226 has a pair of flanges 230 and a pocket 234 therebetween in which a block-like magnetic member 126 is positioned. The magnetic member 126 may be molded into the pocket 234 of the foot pad 218 or assembled into the pocket 234. In the illustrated embodiment, the flanges 230 are temporarily deformed, are inserted through the opening 214, and then engage a bottom surface 238 of the base 18 to releasably secure the foot pad 218 to the base 18.

Figure 10:
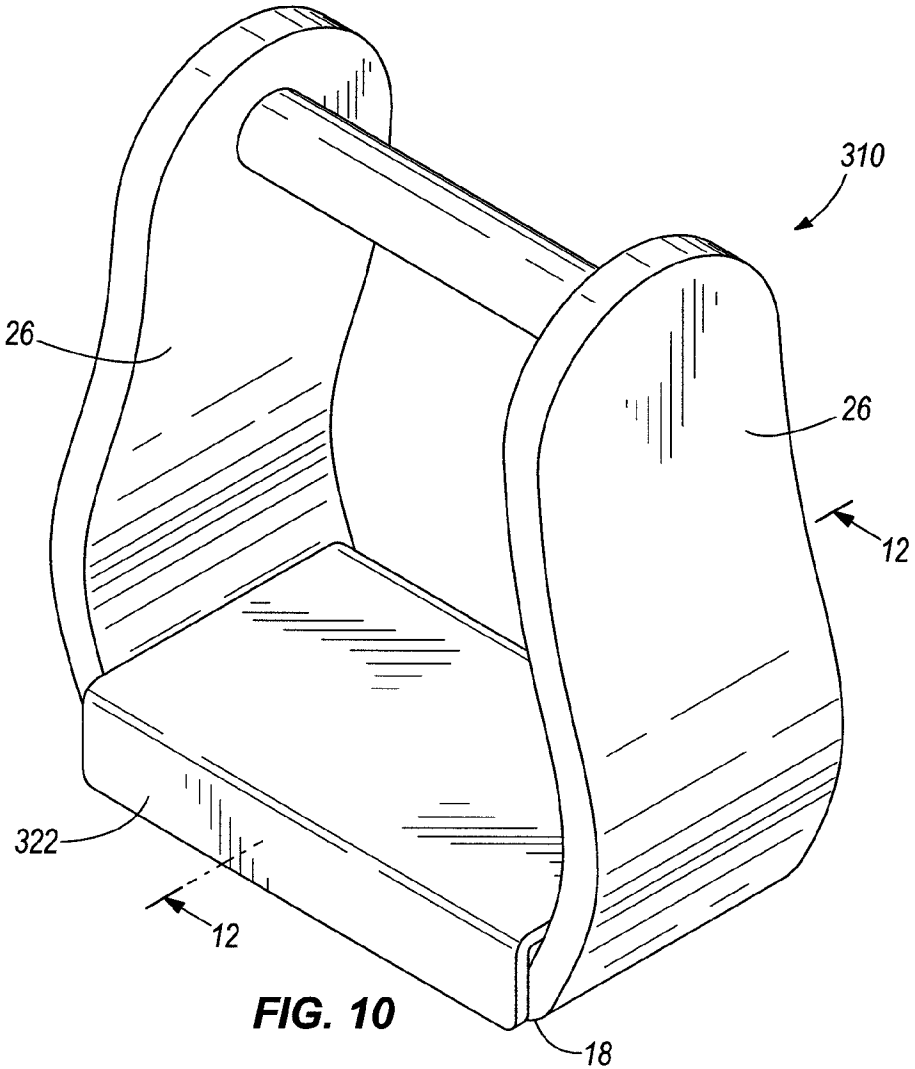
FIG. 10 is a perspective view of a magnetic stirrup according to another embodiment of the invention.
Figure 12:
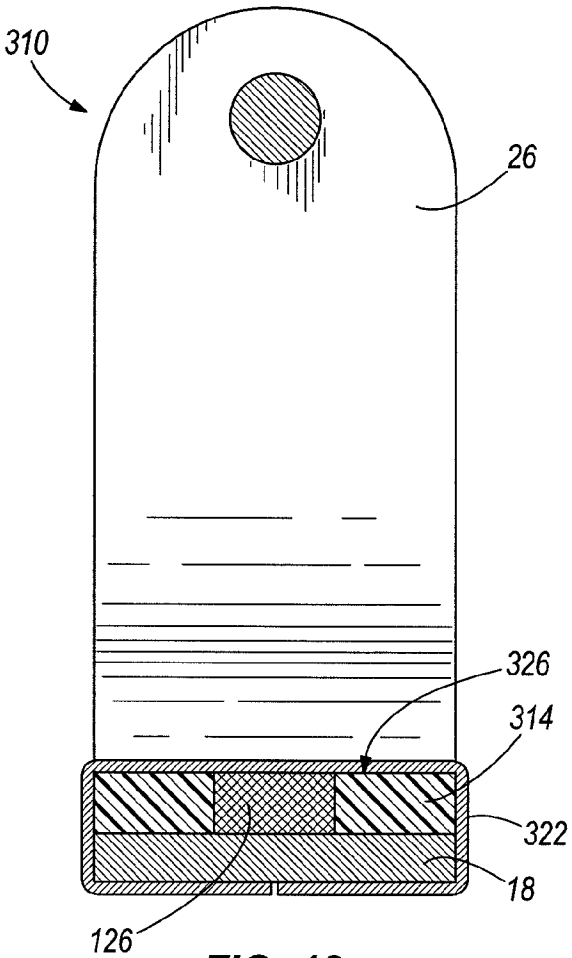
FIG. 12 is a cross-section view of the magnetic stirrup taken along line 12-12 in FIG. 10.
Figure 11:
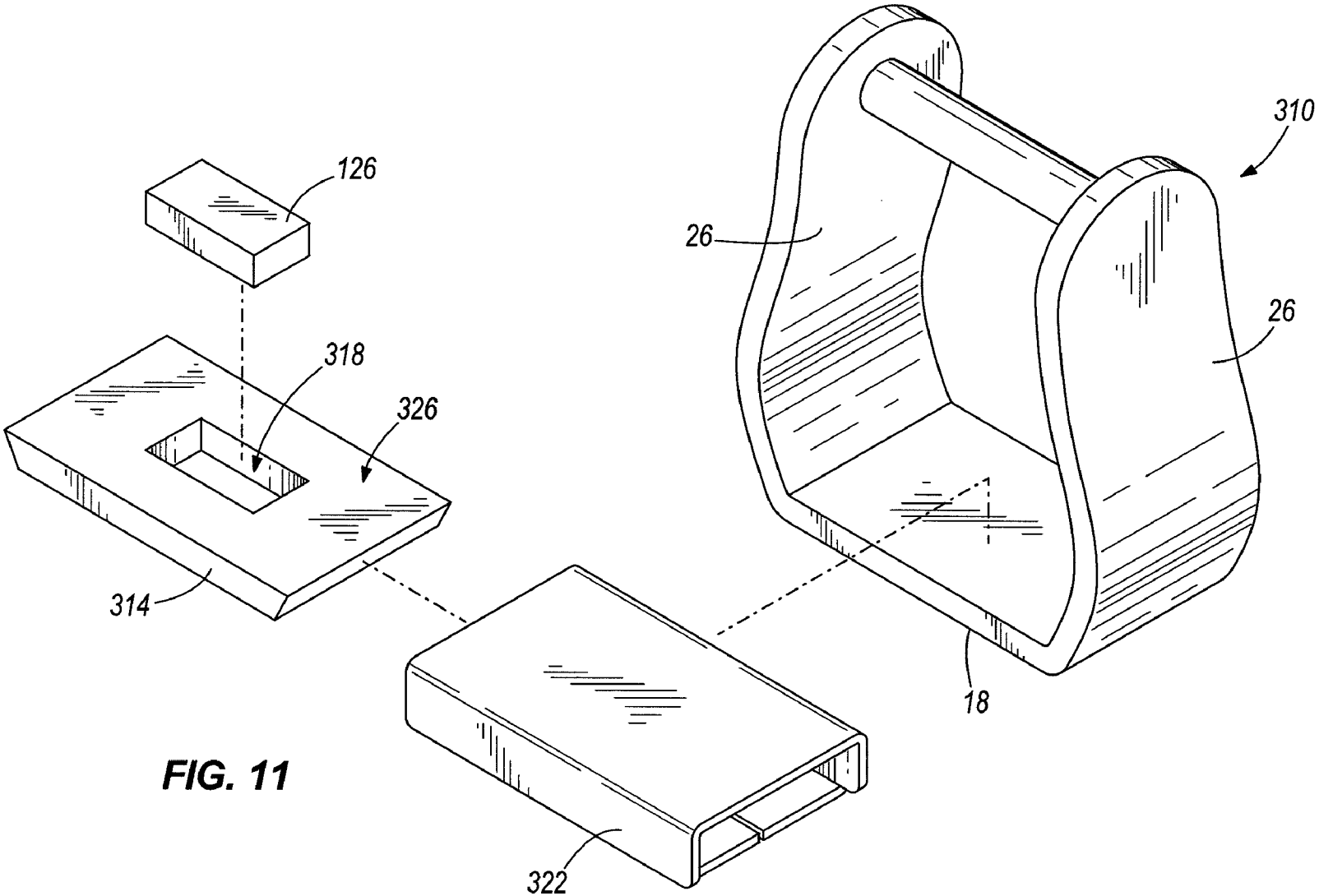
FIG. 11 is an exploded view of the magnetic stirrup shown in FIG. 10.

FIGS. 10-12 illustrate a magnetic stirrup 310 according to another embodiment of the invention. The magnetic stirrup 310 is similar to the magnetic stirrup 10 shown in FIGS. 1-3; therefore like structure is identified by the same reference numerals. The magnetic stirrup 310 includes a spacer 314, a block-like magnetic member 126 positioned in an opening 318 of the spacer 314, and a cover 322 that surrounds the spacer 314, the magnetic member 126 and the base 18 of the stirrup 310. The spacer 314 maintains position of the magnetic member 126 and is positioned on the base 18 between the branches 26 of the stirrup 310. The magnetic member 126 is held in the opening 318 either substantially flush with a surface 326 opposite of the base 18 or recessed into the spacer 314. The cover 322 is placed around the spacer 314 and the base 18 and is held in place by adhesive or fasteners. In some embodiments, the cover 322 is temporarily deformed to fit around the spacer 314 and the base 18. The cover 322 may be formed of plastic, steel, leather, or another type of material. In some embodiments, a thin steel plate is positioned between the magnetic member 126 and the base 18 to increase the effectiveness of the magnetic member 126, similar to the backer plate discussed above with respect to FIGS. 1-3.

In some embodiments, a non-magnetic stirrup having a cover and a base can be modified to include a magnetic system, which comprises the spacer 314, the magnetic member 318 and the cover 322 shown in FIGS. 10-12. Thus, an existing stirrup is modified to magnetically attract a riding boot, such as the riding boot 14 shown in FIGS. 1-3.

In some embodiments, the opening 318 can be directly formed in the stirrup 310 and configured to receive the magnetic member 126 with the cover 322 substantially surrounding the hole 318 and the magnetic member 126.

Figure 13B:
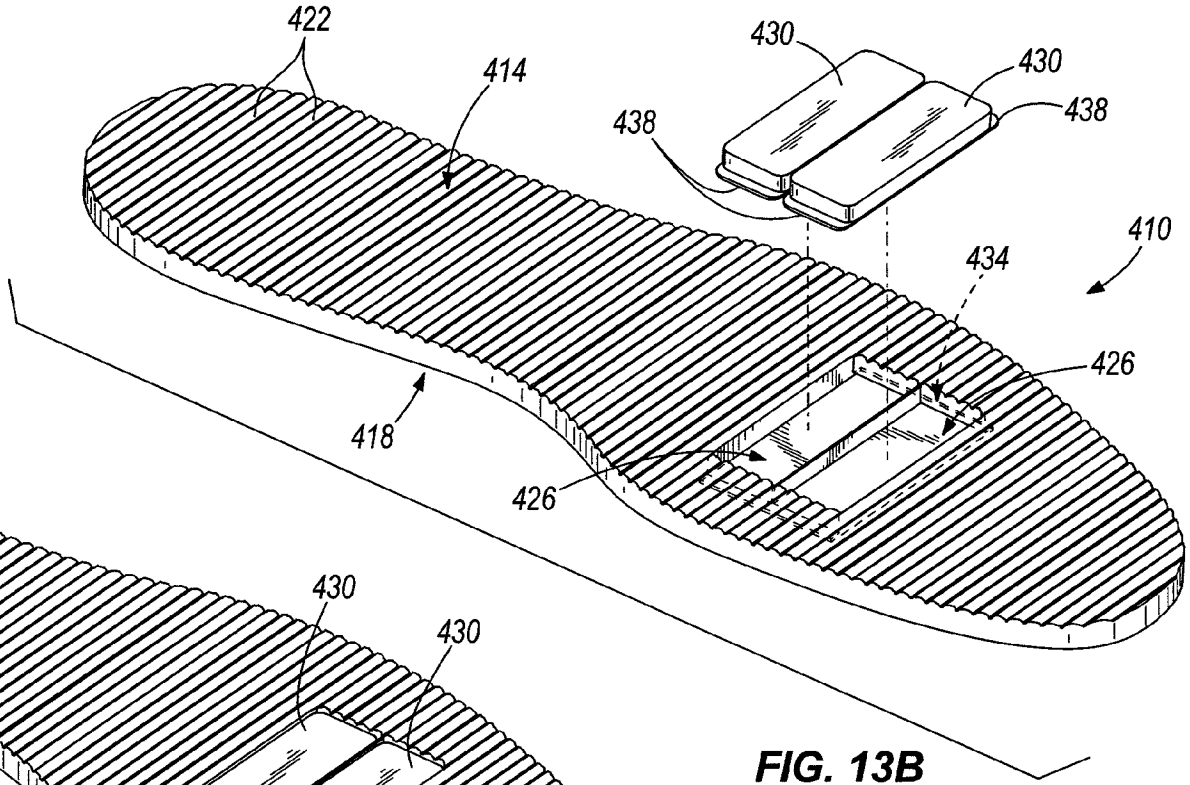
FIG. 13B is an exploded view of the magnetic member and the sole shown in FIG. 13A.
Figure 13A:
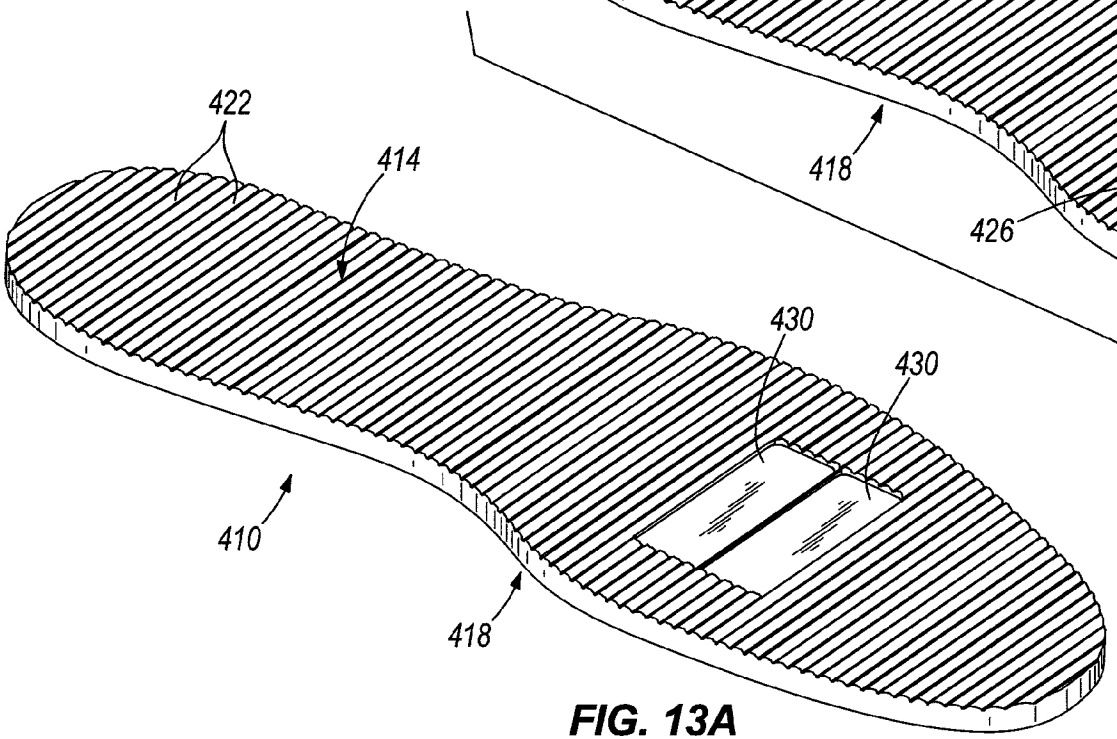
FIG. 13A is a perspective view of a magnetic member for a sole of the riding boot according to another embodiment of the invention.

FIGS. 13A and 13B illustrate a boot sole 410 for the riding boot 14 according to another embodiment of the invention. The boot sole 410 is magnetically attracted to a stirrup (e.g., stirrups 10,110, 210 or 310) having a magnetic member (e.g., magnetic members 50 or 126) coupled thereto. The sole 410 is generally formed of rubber or other polymeric material, and includes a first surface 414 for engaging the stirrup and a second surface 418 opposite the first surface for attaching to the riding boot 14. The first surface 414 includes ribs or treads 422 to frictionally engage the stirrup.

The sole 410 also includes openings or pockets 426 for receiving respective magnetic members 430. The magnetic members 430 are positioned in the openings 426 and are recessed from the first surface 414. The openings 426 extend from the first surface 414 into the sole 410, and each opening 426 includes channels 434 extending substantially parallel to the first and second surfaces 414, 418. The channels 434 extend wider than the openings 426 and receive tabs 438 of the magnetic members 430. In some embodiments, the opening or pockets 426 are formed with a hot knife, sanding, or other machining process.

The magnetic members 430 are two metal plates (e.g., two steel plates) spaced slightly apart from one another. In other embodiments, the sole 410 may include more or less than two magnetic members 430. In some embodiments, the magnetic members 430 are recessed from the first surface so as to prevent a user from walking on the magnetic members 430, which may cause various sounds and slipperiness for the user. In other embodiments, the magnetic members 430 may be flush with the first surface 414, which may increase the magnetic effectiveness of the magnetic members 430 in comparison with the recessed position. The gap or spacing between the two plates (i.e., the magnetic members 430) allows the sole 410 to flex during use. In other embodiments, the magnetic members 430 are other shapes and objects, such as round tock, pellets or other constructions of magnetic material so as to form the magnetic member 430. The tabs 438 extending from the magnetic members 430 are held in the channels 434 and resist removal of the magnetic members 430 from the sole 410.

Figure 14:
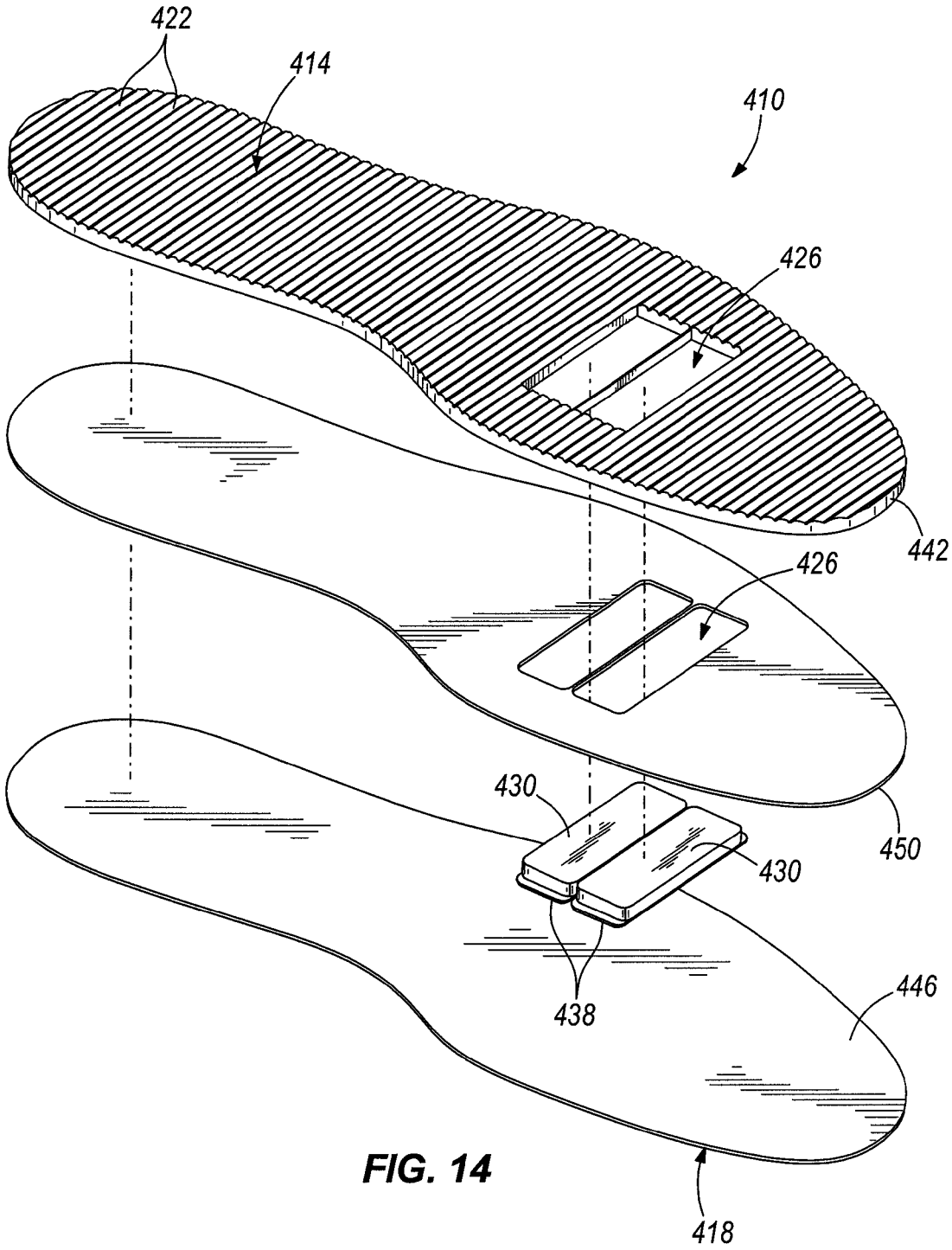
FIG. 14 is an exploded view of a magnetic member for a sole of the riding boot according to another embodiment of the invention.

In some embodiments, the magnetic members 430 are injection molded into the openings 426 and channels 434. In another embodiment shown in FIG. 14, the sole 410 is formed of multiple layers 442, 446, 450 and the magnetic members 430 are assembled between the layers of the sole 410. In particular, the layers of the sole 410 shown in FIG. 14 include an outer sole 442 including the ribbed surface 414 for engaging the stirrup, a base sole 446 for engaging the riding boot and a mid-sole 450 positioned between the outer and base soles 442, 446. The outer sole 442 and mid-sole 450 include the openings 426 in which the magnetic members 430 are inserted therethrough. The tabs 438 of the magnetic members 430 are positioned between the mid-sole 450 and the base sole 446. The width of the openings 426 is less than the distance from the extremities of the tabs 438 and thus resists removal of the magnetic members 430 from the sole 410. The layers 442, 446, 450 may be assembled using adhesive or fasteners.

In some embodiments, the first magnetic member may be imbedded between layers of the riding boot. In some embodiments, a specialized insole may have the first magnetic member imbedded within or may perform as the first magnetic member thereby having magnetic capabilities. In still other embodiments, an additional layer of material, including but not limited to, rubber material or water repellant tape, may be provided between the sole and the mid-sole to prevent water from affecting the mid-sole.

In some embodiments, the tabs 438 are part of a backing plate or other steel plate utilized to increase the effectiveness of the magnetic member(s).

In still other embodiments, the magnetic member 430 is an insole insert that is configured to be removably placed in the interior of the riding boot beneath the foot of the user. The insole insert is formed of a magnetic material, including but not limited to, flexible magnets and steel.

In some embodiments, the sole 410 including the magnetic member 430 is molded around or otherwise coupled to the riding boot 14. In such embodiments, the existing sole of the riding boot 14 may be sanded or otherwise ground off to receive the sole 410.

In yet other embodiments, the sole 410 is substantially formed of metal, steel, or other magnetic material. The sole 410 is molded using injection molding (i.e., high or low pressure injection molding), gravity molding, vacuum molding, or any molding process. In some embodiments, the sole 410 is formed of alternating layers of rubber or other polymeric material and steel, metal, or other magnetic material. The layers may be assembled using adhesive, fasteners, or other coupling means.

Figure 15:
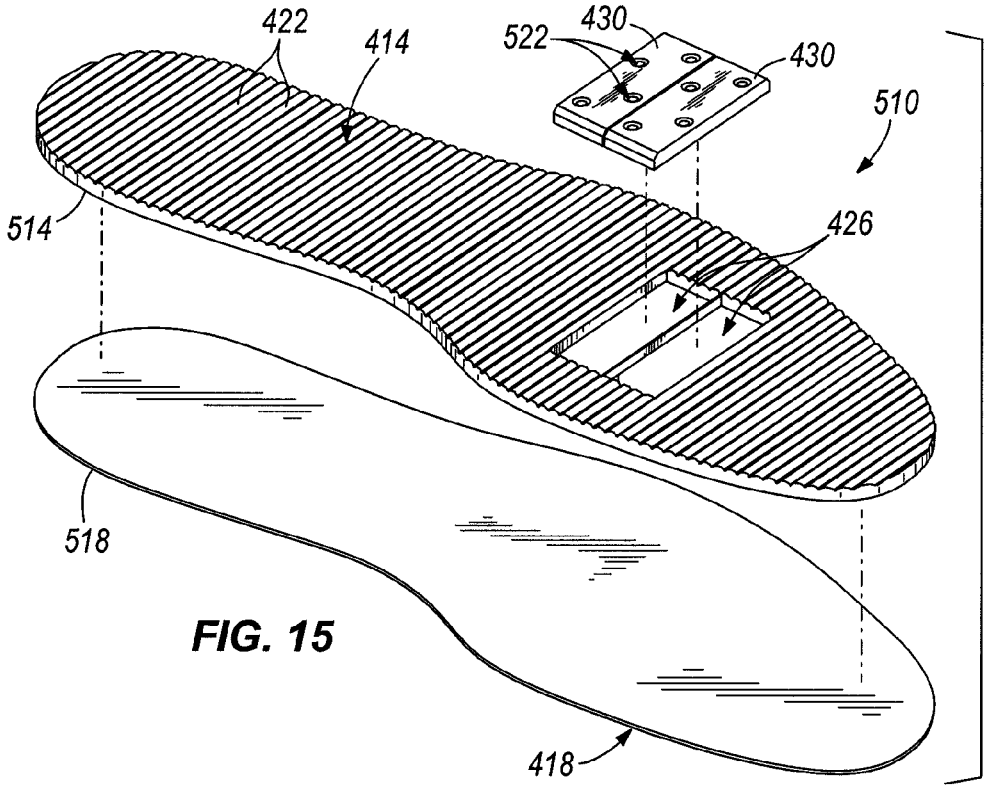
FIG. 15 is an exploded view of a magnetic member for a sole of the riding boot according to another embodiment of the invention.

FIG. 15 illustrates a boot sole 510 according to another embodiment of the invention. The boot sole 510 is similar to the boot sole 410 shown in FIG. 14; therefore like structure is identified by the same reference numerals. The boot sole 510 comprises two layers 514, 518 and the magnetic members 430 are inserted through the openings 426 in one of the sole layers 514 and coupled to the other sole layer 518 via fasteners (e.g., nails or screws) through multiple apertures 522.

Figure 16:
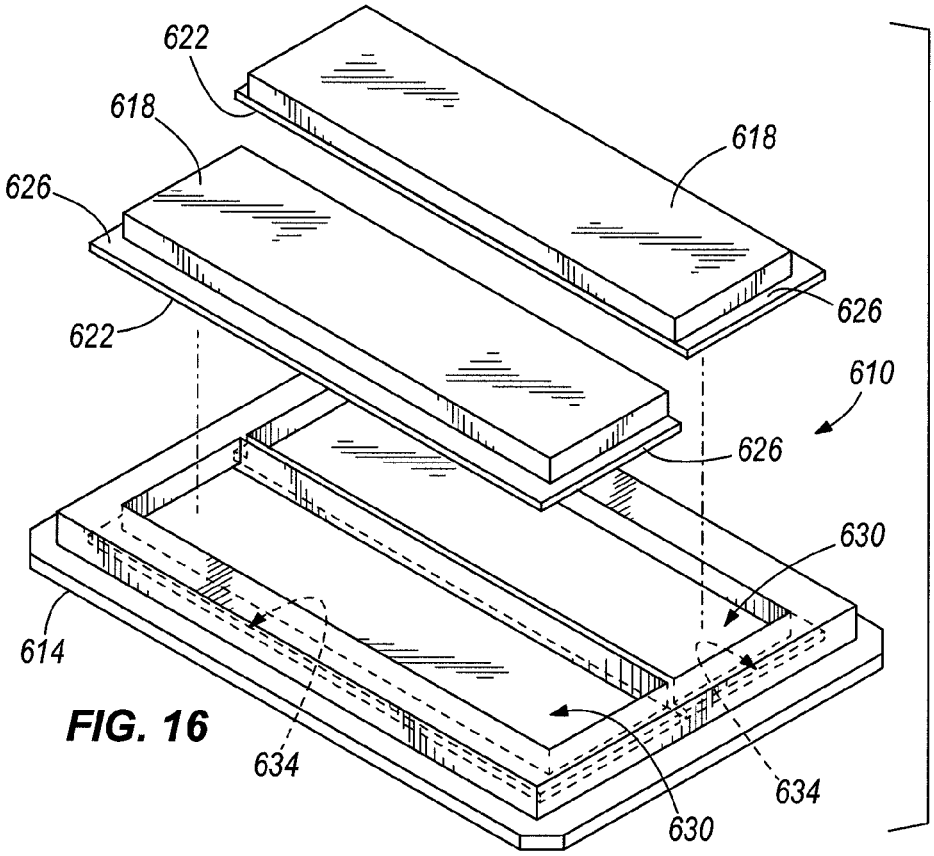
FIG. 16 is an exploded view of a magnetic member for a sole of the riding boot according to another embodiment of the invention.

FIG. 16 illustrates a magnetic system 610 according to another embodiment of the invention. The magnetic system 610 includes a support member 614 formed of, for example, rubber and magnetic members 618 coupled to the support member 614. In the illustrated embodiment, the magnetic system 610 includes two magnetic members 618, although in other embodiments fewer or more than two magnetic members 618 may be utilized. Each magnetic member 618 is formed of steel (e.g., 12 gauge carbon steel) and includes a backing plate 622 formed of steel (e.g., 22 gauge carbon steel). The backing plate 622 extends beyond the magnetic member 618 defining tabs 626. In the illustrated embodiment, the two magnetic members 618 are shown removed from the support member 614 for ease of illustrated. The support member 614 is molded over the magnetic members 618 such that the magnetic members 618 are imbedded in the support members 614. The support member 614 includes openings or pockets 630 for receiving the magnetic members 618, and channels 634 recessed from the openings 630 into the support member 614 for receiving the tabs 626 (i.e., backing plate 622). The tabs 626 are imbedded in the support member 614 to secure the magnetic members 618 in the support member 614.

Figure 16A:
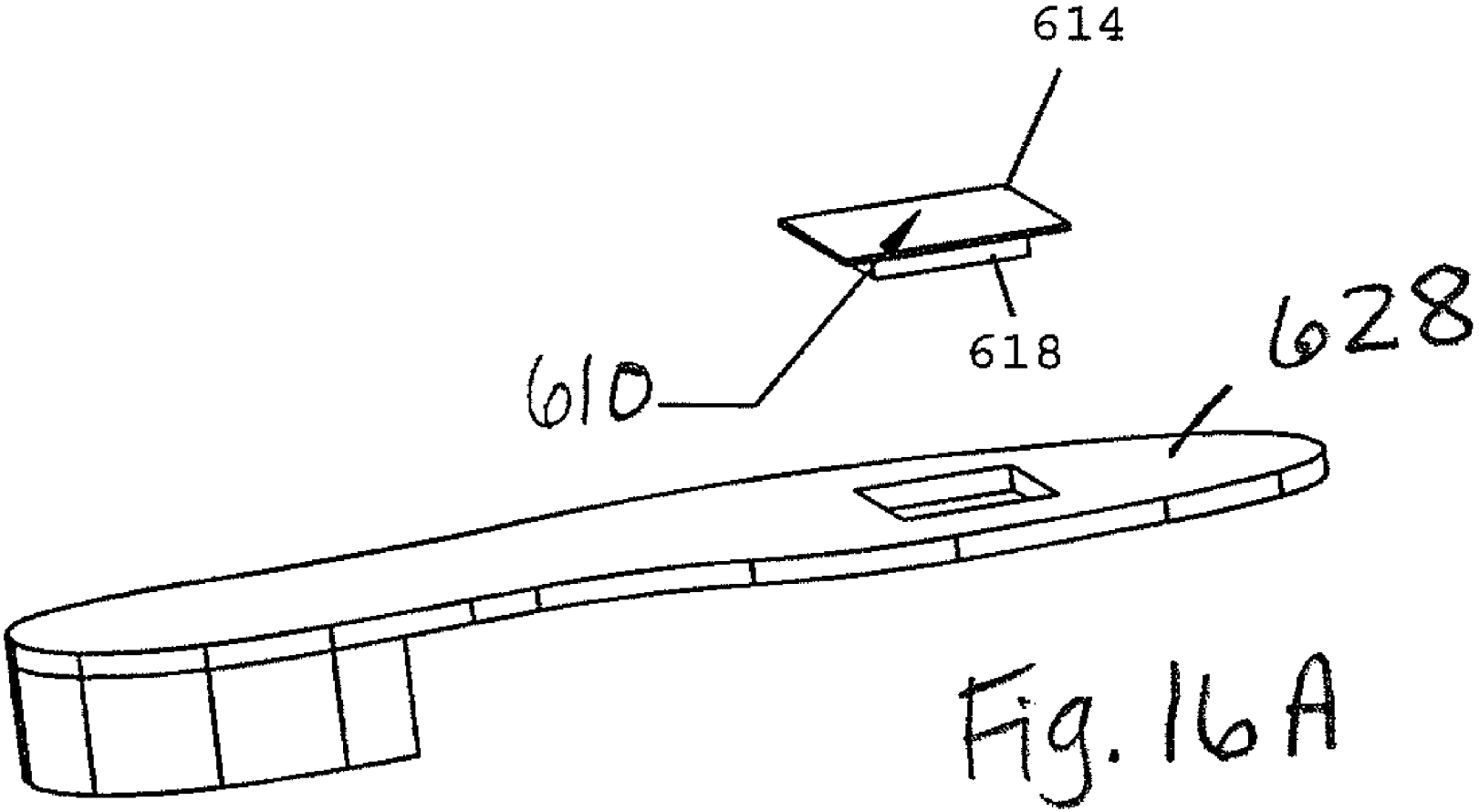
FIG. 16A is an exploded view of the magnetic member of FIG. 16 for positioning in the sole of a riding boot.

FIG. 16A illustrates the magnetic system 610 positioned for placement in a boot sole 628. In the illustrated embodiment, the support member 614 is formed of a polymer, such as plastic, that is injection-molded around the magnetic members 618 to substantially seal the magnetic members 618 in the polymer. The magnetic system 610 may then be assembled into the boot sole 628. Enclosing the magnetic member in the polymeric over-molding protects the magnetic member from rusting or other water damage, as well as reduces the migration of water or other substances into the boot. In some embodiments, the magnetic system 610 may include a texture on it to provide a traction surface for the riding boot.

The magnetic system 610 can be utilized in the place of any of the magnetic members in any of the soles discussed herein. In other embodiments, the support member 614 and the magnetic members 618 are assembled.

Figure 17:
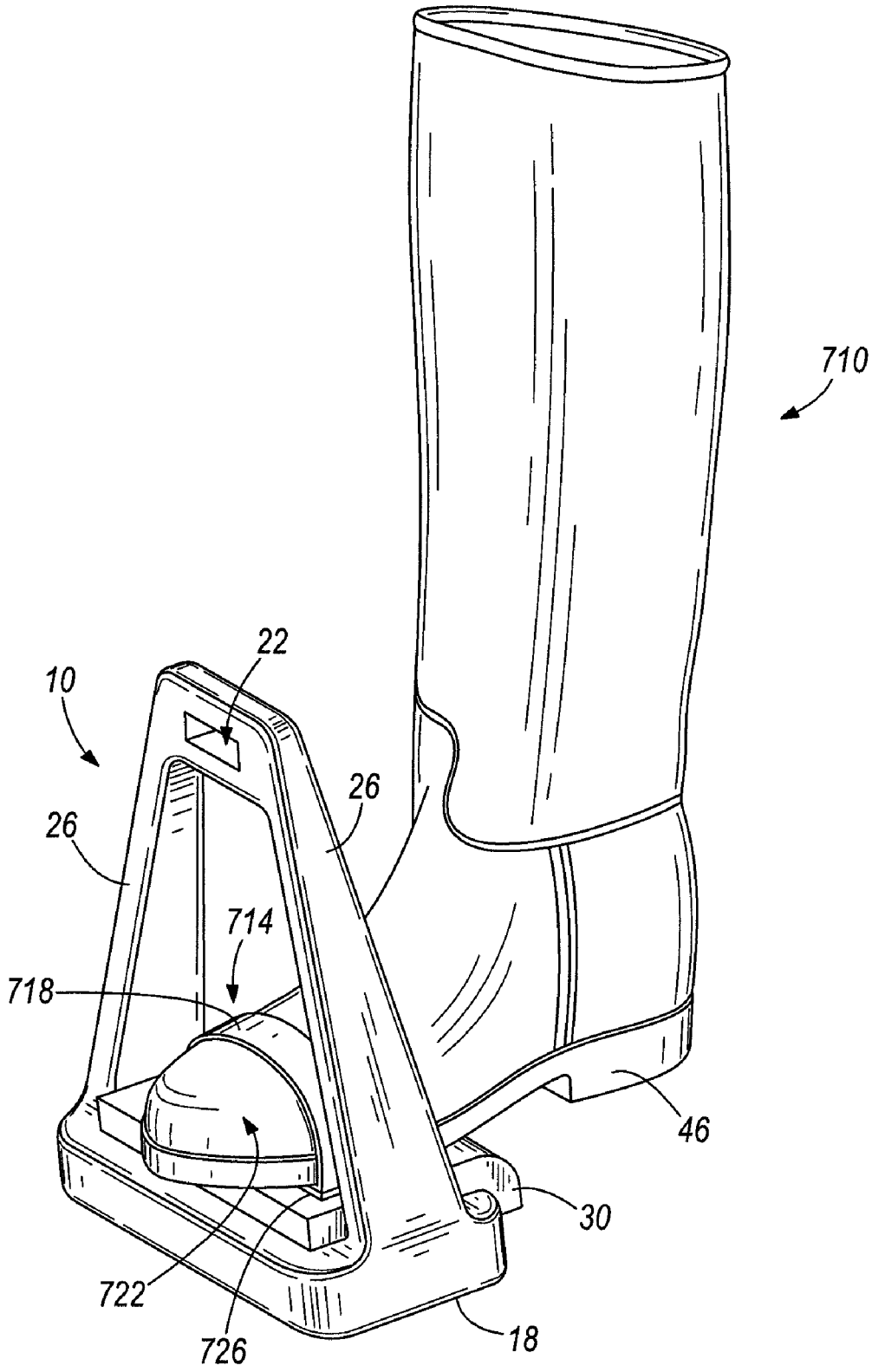
FIG. 17 is a perspective view of a magnetic stirrup and a riding boot according to another embodiment of the invention.
Figure 18:
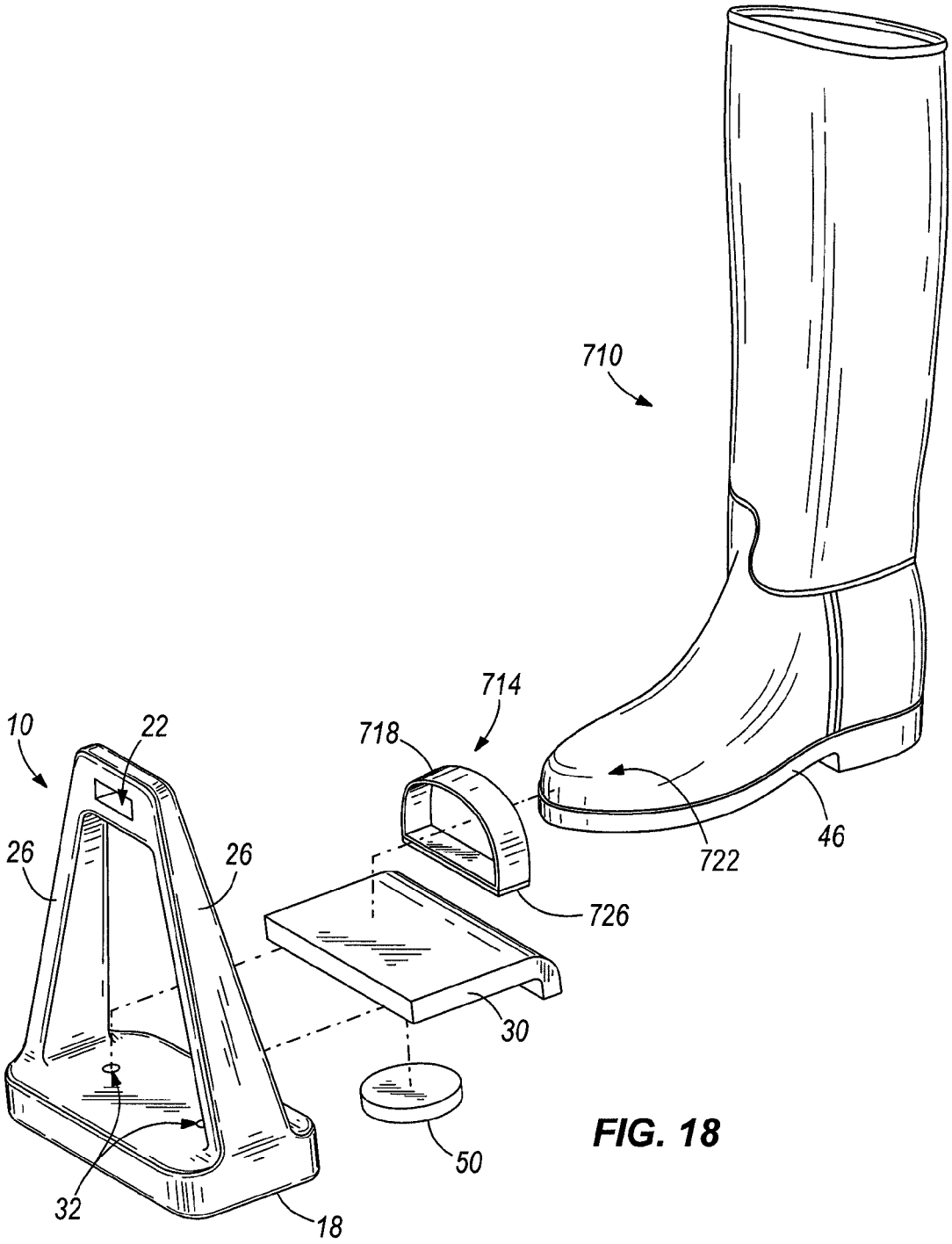
FIG. 18 is an exploded view of the magnetic stirrup and the riding boot shown in FIG. 17.

FIGS. 17 and 18 illustrate the magnetic stirrup 10 of FIGS. 1-3, a riding boot 710 and a magnetic strap system 714 according to another embodiment of the invention. The riding boot 710 illustrated in FIGS. 17 and 18 is similar to the riding boot 14 shown in FIGS. 1-3; therefore, like structure will be identified by the same reference numerals. The strap system 714 includes a band or strap 718 removably coupled to toe 722 of the riding boot 710 and a first attractant or first magnetic member 726 coupled to or imbedded in a bottom of the strap 718. The strap 718 is adjustable and is able to accommodate various contours and sizes of riding boots 710. The first magnetic member 726, similar to the first magnetic member 42 shown in FIGS. 1-3, attracts the second magnetic member 50 in either the foot pad 30, or the stirrup base 18. In some embodiments, the strap 718 is injection molded and the first magnetic member 726 is coupled to or imbedded in the strap 718.

In some embodiments, the first magnetic member 726 is coupled to or imbedded in, for example, a piece of leather, elastic, or rubber that is removably coupled to the toe 722 of the riding boot 710.

Figure 20:
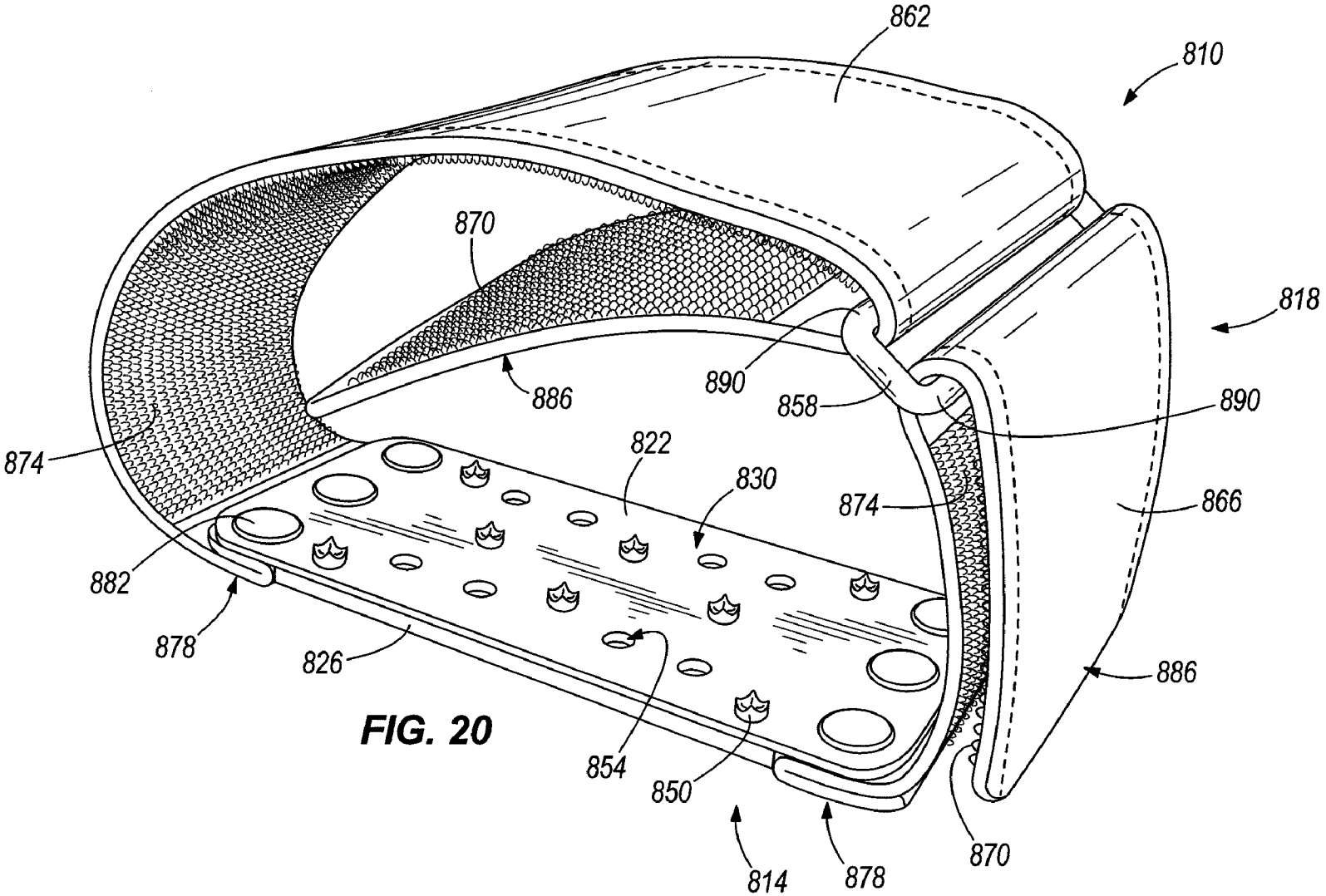
FIG. 20 is another perspective view of the strap system shown in FIG. 19 and illustrating a method of adjusting the strap.
Figure 21:
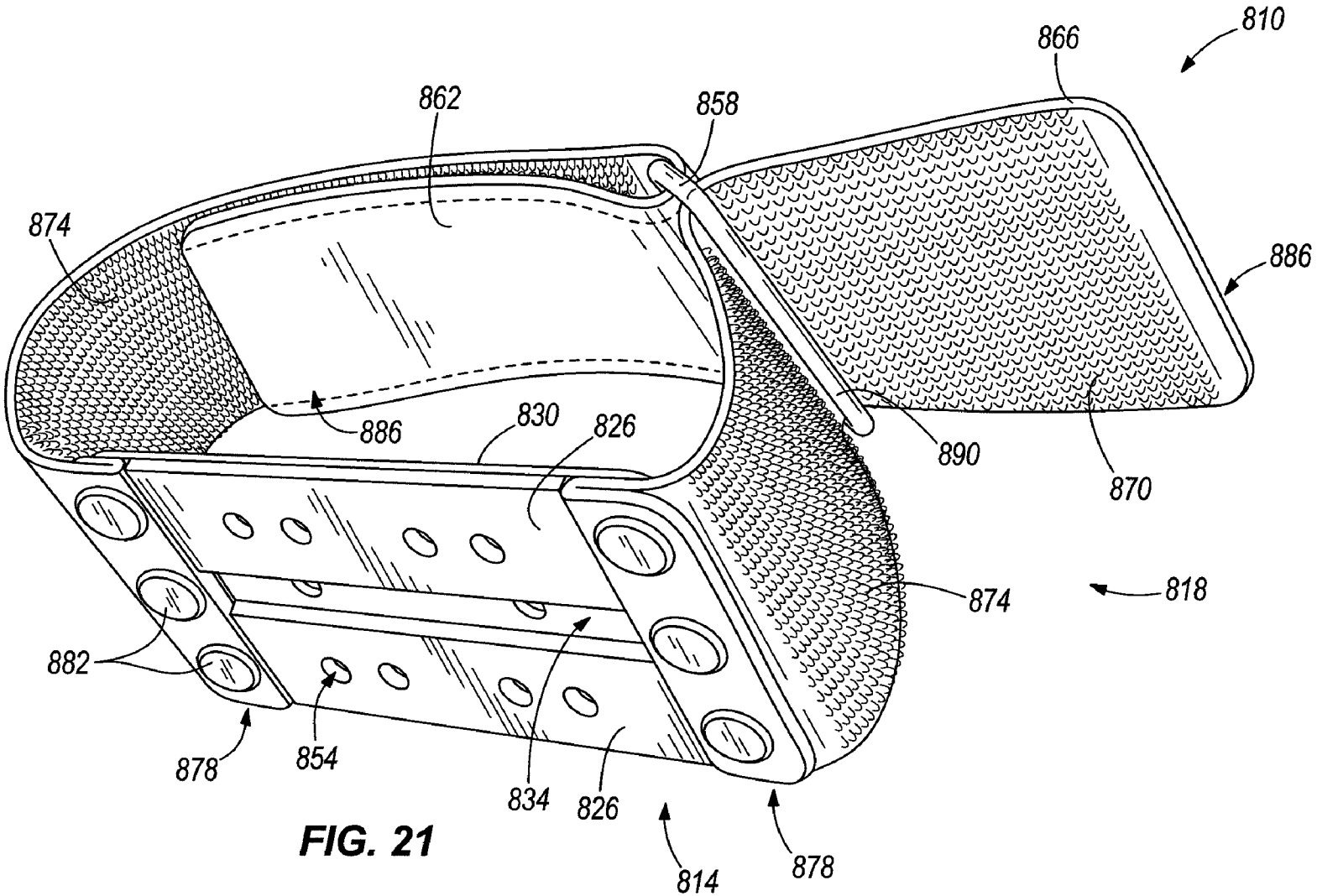
FIG. 21 is yet another perspective view of the strap system shown in FIG. 19 and illustrating another method of adjusting the strap.
Figure 22:
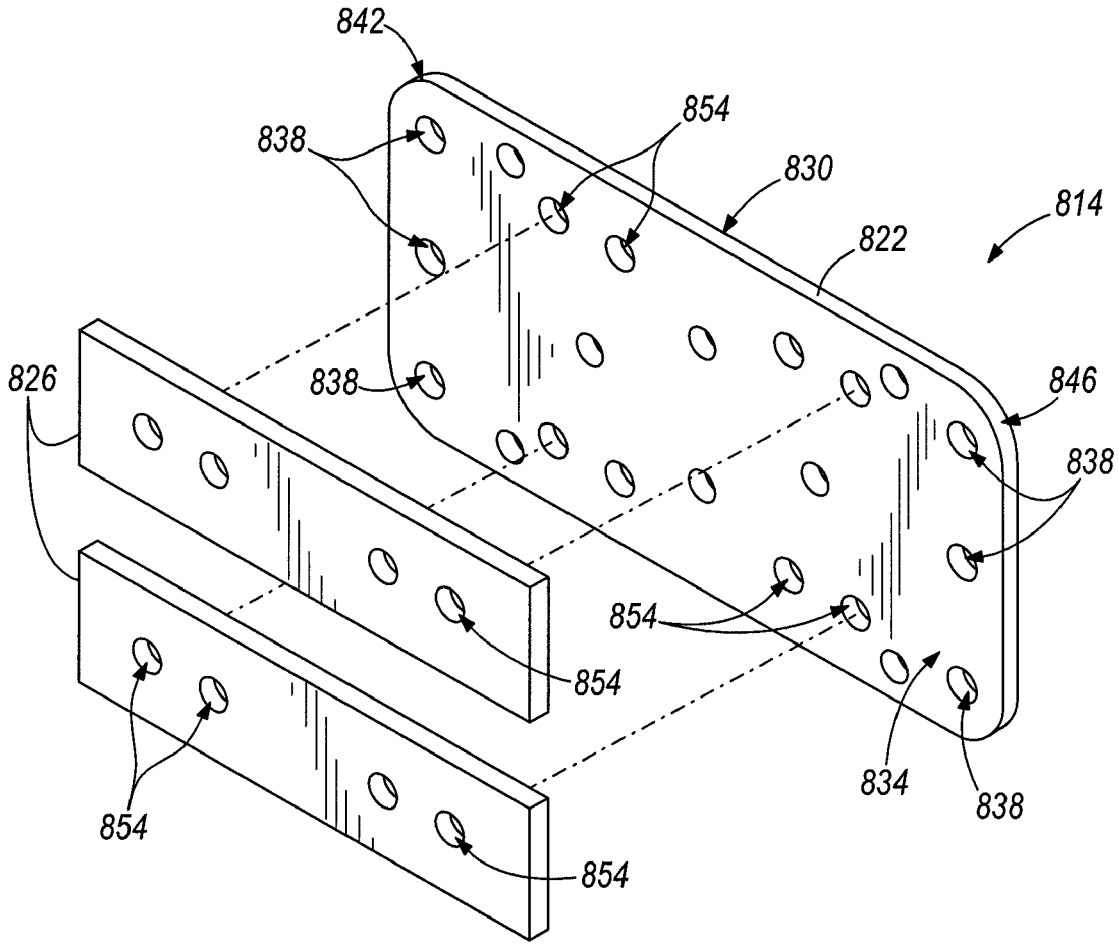
FIG. 22 is an exploded view of a plate system according to another embodiment of the invention.

FIGS. 19-22 illustrate a magnetic system 810 according to another embodiment of the invention. The magnetic system 810 is utilized with a riding boot, such as the riding boot 710 shown in FIGS. 17 and 18, and includes a magnetic plate system 814 and a strap system 818 coupled to the plate system 814. Referring to FIG. 22, the plate system 814 includes a boot plate 822 and magnetic members 826 coupled to the boot plate 822 for attraction to a magnetic stirrup (e.g., stirrups 10, 110, 210 or 310). The boot plate 822 is formed of steel (e.g., 20 gauge carbon steel) and the magnetic members 826 are formed of steel (e.g., 14 gauge carbon steel). The boot plate or backing plate 822 includes a first surface 830 for engaging the riding boot and a second surface 834 opposite the first surface 830 adjacent to the magnetic members 826. The boot plate 822 has multiple fastener apertures 838 extending from the first surface 830 to the second surface 834 at opposite ends 842, 846 of the plate 822, as well as multiple gripper portions 850 extending from the first surface 830 to frictionally engage a sole of the riding boot and thereby provide added traction for the riding boot. The fastener apertures 838 are used to couple the strap system 818 to the plate system 814. In the illustrated embodiment, the boot plate 822 and the magnetic members 826 include multiple through holes 854 formed therein. The holes 854 are utilized to adjust the magnetic effectiveness of the plate system 814. In other words, by removing material from the boot plate 822 and the magnetic members 826, the magnetic attraction increases.

In the illustrated embodiment, two magnetic members 826 are spot welded to the boot plate 822, although in other embodiments, various affixing methods may be used to couple the magnetic members 826 to the boot plate 822. In other embodiments, the plate system 814 may include more or less than two magnetic members 826.

The strap system 818 defines an adjustable portion of the magnetic system 810 and includes a ring 858, a first (main) strap 862 and a second (secondary) strap 866. In the illustrated embodiment, the ring 858 is made of steel (e.g., stainless steel) and the straps 862, 866 are made of leather (e.g., chap leather), which is generally smooth leather. Each strap 862, 866 includes a hook portion 870 and a loop portion 874 defining a hook-and-loop type strap system 818. The edges of the hook and loop portions 870, 874 are flush with the edges of the leather straps 862, 866. In the illustrated embodiment, the hook and loop portions 870, 874 are coupled to the straps 862, 866 using adhesive, although other methods, such as stitches, can be utilized. One end 878 of each strap 862, 866 is folded and coupled to the plate system 814, specifically to the opposing ends 842, 846 of the boot plate 822 via rivets 882 (e.g., double cap rivets), although other fastening methods may be used. The folded strap ends 878 abut the magnetic members 826 and have approximately the same thickness (when folded) as the thickness of the magnetic members 826. The folded strap ends 878 provide added strength in the coupling of the straps 862, 866 to the plate system 814.

Figure 19:
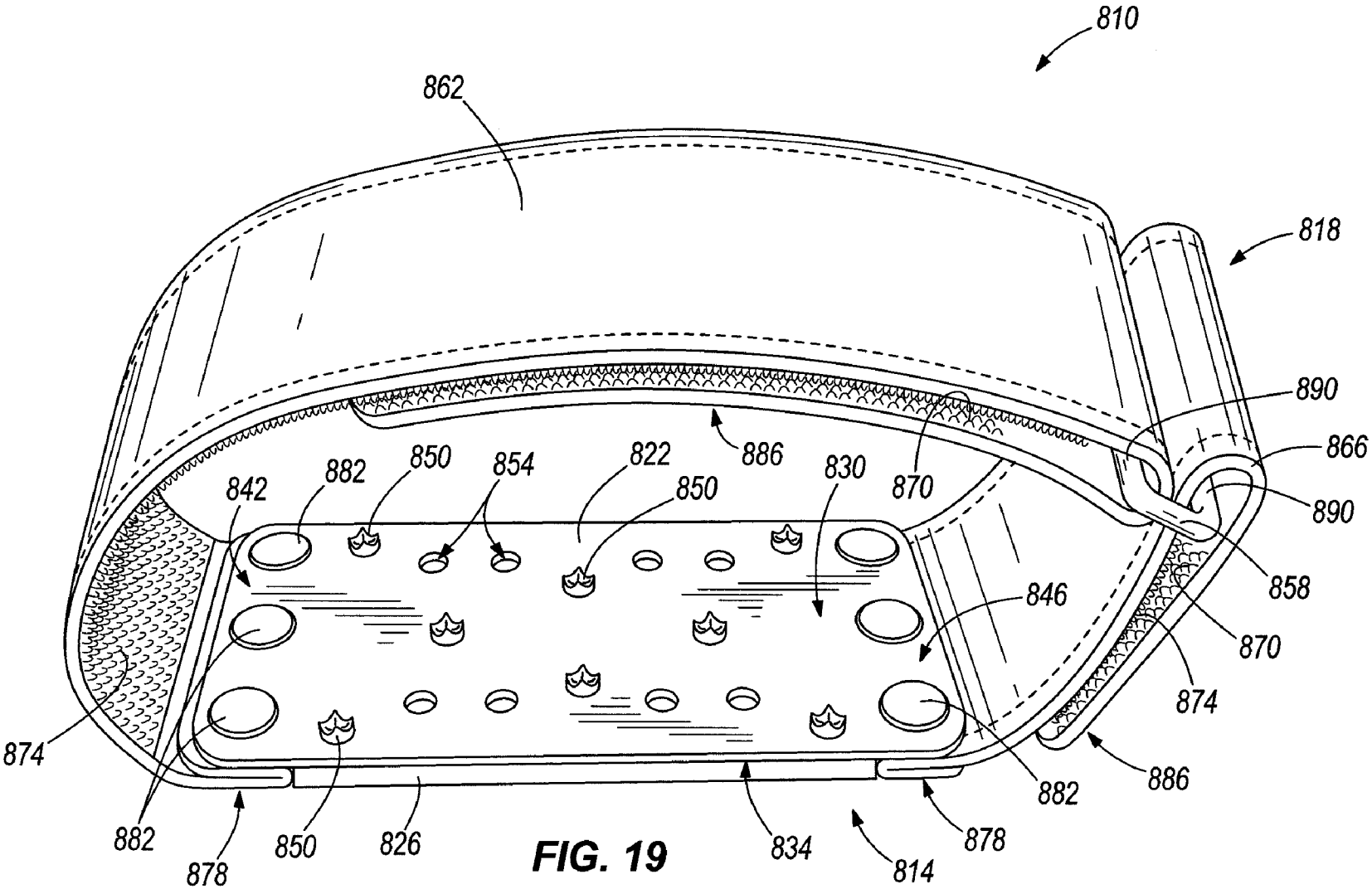
FIG. 19 is a perspective view of a strap system for the riding boot according to another embodiment of the invention.

Another end 886 of each strap 862, 866 is inserted through the ring 858 and wrapped around respective sides 890 of the ring 858 so as to define a closed or assembled position, as shown in FIGS. 19-21. In an open position, at least one of the straps is removed from the ring 858 and the hook and loop portions 870, 874 of each strap 862, 866 are separated from one another. Thus, the straps 862, 866 may be laid flat or substantially parallel with the boot plate 822 (i.e., the first and second surfaces 830, 834). In the open position, the straps 862, 866 have a substantially curved shape, which allows the strap system 818 to fit the contours of the riding boot (e.g., the toe 722 shown in FIGS. 17 and 18). In the illustrated embodiment, the first and second straps 862, 866 have a radius of approximately 12.25 inches, although in other embodiments other radii amounts may be used.

The first and second straps 862, 866 are adjustable to fit the strap system 810 securely onto the riding boot. Generally, the first strap 862 provides rough adjustment of the size of the strap system 810 and the second strap 866 provides fine adjustment for the size of the strap system 810. Particularly, the first strap 862 is used prior to attaching the strap system 810 to the riding boot. Referring to FIG. 20, a user roughly adjusts the hook and loop portions 870, 874 of the first strap 862 until the closed circumference of the strap system 810 is slightly larger than the circumference of the riding boot. Then, the strap system 810 is attached to the riding boot and, referring to FIG. 21, the user adjusts the hook and loop portions 870, 874 of the second strap 866 until the strap system 810 fits to a desired tightness around the riding boot.

In some embodiments, the boot plate 822 and/or the magnetic members 826 include a finishing coat, which may comprise a liner, a mask or other coatings. The coating may be applied through immersion or spraying. Further, various known manufacturing techniques may be applied to resist running and overspray of the coating.

In other embodiments, hook and loop fasteners, adhesive (e.g., double sided tape), rubber bands and/or string may be utilized to attach the stirrup to the riding boot.

In one embodiment of the invention, magnetic pedals are provided for a bicycle. Like the magnetic stirrup 10 described above, each of a rider's shoes includes a first magnetic member. The first magnetic member may be similar to either the first magnetic member 42 (FIGS. 2 and 3), which is a magnet coupled to or imbedded in a sole of the shoe, or similar to the first magnetic member 726 (FIGS. 17 and 18), which is a magnet coupled to or imbedded in straps that couple to the shoes. Each shoe includes an incline or ramp integrally formed in the sole of the shoe or coupled to the sole of the shoe. In some embodiments, the first magnetic member is imbedded in or coupled to the incline and each incline is removably coupled to the shoes.

The pedal includes a base and a second attractant or second magnetic member. The second magnetic member may be similar to the second magnetic member 50 (FIGS. 2 and 3), which is a magnet coupled to or imbedded in the base of the pedal. Each base includes an incline or ramp having a complementing shape to the shoe ramp. In other embodiments, the second magnetic member is coupled to or imbedded in a tread or pad associated with the pedal. The tread or pad may include a frictional surface for the rider's shoes to abut, and may couple to or be integrally formed with the base.

The rider's shoes and the pedals are magnetically coupled to one another via the magnetic field created between the first magnetic member and the second magnetic member. When the shoes are inserted in or positioned on the pedals, toward a riding position, the ramps of the shoes and the bases mate. The first and second magnetic members are thereby brought into a magnetic range of one another and cause the shoes and pedals to magnetically attract to one another. When the ramps are mated and therein magnetically coupled, the rider's shoes are positioned in a proper and comfortable riding position. To release the rider's shoes from the pedal, the shoes are pivoted or twisted sideways such that the ramps slide and rotate against one another to create a space between the ramps and break the magnetic bond therebetween. In some embodiments, the first and second magnetic members of the shoes and pedals limit or remove the requirement of clips for the bicycle pedals.

Thus, the invention provides, among other things, a stirrup that either attracts or is attracted to a riding boot through magnetic attraction. Although the invention has been described in detail with reference to certain preferred embodiments, variations and modifications exist within the scope and spirit of one or more independent aspects of the invention as described.

What is claimed is:

1. A riding boot for use with a stirrup, the riding boot comprising:

a sole for engaging the stirrup, the sole coupled to the riding boot and including a first sole layer and a second sole layer interior to the first sole layer;

at least two magnetic members positioned adjacent each other in a row in a fore-aft direction of the riding boot at a forward portion of the riding boot, each magnetic member being positioned in an opening in the first sole layer, and each magnetic member including a plurality of apertures; and a plurality of fasteners, each of the fasteners being received by a corresponding one of the plurality of apertures to couple the magnetic member to the sole of the riding boot, wherein each of the magnetic members is secured to the second sole layer with the plurality of fasteners.

2. The riding boot of claim 1 wherein each of the magnetic members is a steel plate.

3. The riding boot of claim 1 wherein the first sole layer of the sole includes a first surface for engaging the stirrup and a second surface opposite the first surface, and further wherein each of the magnetic members is recessed from the first surface.

4. The riding boot of claim 3 wherein the first surface includes treads, and the recessed area is open to the first surface.

5. A method of manufacturing a sole for a riding boot, the method comprising:

providing first and second sole layers, the second sole layer being interior to the first sole layer, the sole configured for coupling to the riding boot;

forming a pocket in the first sole layer;

inserting a magnetic member in the pocket;

providing the magnetic member with a plurality of apertures;

inserting fasteners through corresponding apertures of the plurality of apertures in the magnetic member to secure the magnetic member to the second sole layer; and substantially surrounding the magnetic member with a polymeric material.

6. The method of claim 5, further comprising forming the magnetic member as at least one steel plate.

7. The riding boot of claim 1 wherein each of the magnetic members is a polymer including a magnetic metal.

8. The method of claim 5, further comprising forming the magnetic member as a polymer including a magnetic metal.

* * * * *